US005331608A

United States Patent [19]

Umemoto et al.

[11] Patent Number: 5,331,608

[45] Date of Patent: Jul. 19, 1994

[54] ELECTRONIC WATCH WITH AN ANTENNA FOR A RECEIVING DEVICE

[75] Inventors: Toshio Umemoto; Toshio Hiruta; Kunikazu Mochida, all of Tanashi, Japan

[73] Assignee: Citizen Watch Co., Ltd., Tokyo, Japan

[21] Appl. No.: 36,849

[22] Filed: Mar. 25, 1993

[30] Foreign Application Priority Data

Mar. 31, 1992 [JP] Japan ..... 4-026505[U]
Oct. 23, 1992 [JP] Japan ..... 4-079906[U]
Jan. 8, 1993 [JP] Japan ..... 5-002573[U]

[51] Int. Cl.[5] ..... G04C 11/02
[52] U.S. Cl. ..... 368/10; 368/47; 368/55
[58] Field of Search ..... 368/46-61, 368/10

[56] References Cited

U.S. PATENT DOCUMENTS 4,884,252 11/1989 Teodoridis et al. ..... 368/10
5,172,348 12/1992 Paratte ..... 368/47
5,235,563 8/1993 Ganter et al. ..... 368/48

*Primary Examiner*—Bernard Roskoski
*Attorney, Agent, or Firm*—Kanesaka & Takeuchi

[57] ABSTRACT

In a wrist watch equipped with a receiving device, an antenna 19 having an antenna winding **19*b*, wound around an antenna core 19*a* with the end thereof being fixed, and having a conductible antenna terminal sheet 19*d* secured to an antenna winding frame 19*c* is inserted from a notch 10*k* in a dial 10 and secured with a screw 35 to an antenna support plate 33 which is secured to a circuit substrate 22, there by conducting the antenna 19** and the watch module. The construction ensures simplification of the watch module structure and easy conduction and securing of the antenna and the watch module and secured, with little influence on the receiving performance.

17 Claims, 14 Drawing Sheets

ELECTRONIC WATCH WITH AN ANTENNA FOR A RECEIVING DEVICE

BACKGROUND OF THE INVENTION

1. Field of the Invention

The present invention relates to a structure for an analogue-type electronic wrist watch, and, in particular to a structure for an electronic wrist watch equipped with a receiving device which has a built-in antenna for receiving a signal; to a mode switching structure for a multifunctional analogue wrist watch; and to a gear train modification mechanism for escaping from a condition in which it is impossible to reverse a step motor for a watch with a hand sector display.

2. Description of the Related Art

In recent years there has been a remarkable growth in portable devices using radio signals, and these have been commercialized in many fields. The field of wrist watches has been no exception, and, those utilizing radio signals, including radio-equipped watches, have been commercialized, although the number is not great. However, to use radio signals, not only it is necessary to have parts which are completely different from conventional timepiece parts, but methods to ensure that the receiving performance is not adversely affected must also be taken into consideration.

Among such parts, the antenna, which has a particularly significant influence on the performance of receiving radio signals, also is rather large in comparison with the parts of conventional wrist watches. There are also placement restrictions with respect to reception performance. In addition, there is also a space problem; i.e., installing the antenna inside the timepiece makes it difficult to make the wrist watch small.

Furthermore, enclosing the antenna in a metal casing must be avoided for ensuring good reception performance, posing a problem of design restrictions.

As a method to eliminate the above-mentioned problem areas, products with a structure in which the antenna is separated from the timepiece module have been commercialized. In one such structure the antenna is provided in a band, as disclosed in Japanese Patent Laid-open (kokai) No. 126408/1990. In another such structure the antenna is provided in the outer periphery of the timepiece casing so as to design the body of the wrist watch small and thin, as disclosed in Japanese Patent Laid-open (kokai) No. 38034/1989.

However, in the structures wherein the antenna is provided in the band or in the outer periphery of the watch casing, it is inevitable that the antenna must pass through the watch module into the casing. This is a major restriction from the aspect of both structure and reliability, if water proofing structure is provided for this part considering the environment in which the watch is used.

Also, in the case where the antenna is provided in the band, it is impossible to use a metal band because of the reception performance. A special watch band such as a leather band or the like must therefore be used. This causes the problem of restrictions in the type of watch band when designing the overall watch. In addition, replacement of the watch band must accompany the replacement of the antenna as well, increasing the overall costs. In the same manner, when the antenna is provided in the external periphery of the casing, there are significant restrictions on the design, because of linearity of the antenna and depending on the structure in which the antenna is fixed and inserted.

Accordingly, a first object of the present invention is to provide, with due consideration to the drawbacks of such conventional structures, an electronic wrist watch equipped with a receiving device wherein the connection between the antenna and the watch module is simple, there is no influence on the reception performance of the antenna, and there are also very few restrictions on the design of the watch.

Beside the above-mentioned antenna reception function, there are various other functions, such as a stop watch function, a timer function, and the like, provided to a multifunctional analogue wrist watch in addition to the main function of indicating normal time. It is common for these to carry out the specified functional operation through an ON/OFF switch for electrical contacts by manipulating an external operating member such as a push-pull button or the like.

However, the number of hands and external operating members in the watch is restricted. As the number of functions increases it is only natural to use the same hands for double duty in indicating the functions. Furthermore, in the external operating member, various functional operations are also performed using the same external operating member. Accordingly, with a multifunctional analogue wrist watch with a large number of functions, using the timepiece mode for each of these functions in turn, it is difficult to decipher what the hand is intended to indicate because the functions of the hands and the external operating members differ depending on the mode. There is therefore the problem that errors occur in the operation of the external operating member.

As a method of eliminating the above-mentioned problem areas, there are commercial products provided with a mode hand or the like to indicate the details of the function of the watch. This mode hand is driven by the operation of the external operating member to decipher the details of the hand and the details of the operation of the external operating member by indicating the watch mode for the function which is in current use.

However, in the operation of the external operating member in the above manner, a mode switching structure which indicates the mode for the function with a mode hand or the like is complicated in comparison with a switch structure using an ON/OFF operation of an electric contact. In addition, there are restrictions on the stroke of the external operating member when switching the mode, imposing structural restrictions.

Furthermore, a multifunctional analogue wrist watch is provided with plurality of gear trains and step motors for driving the various functions. The step motors are comparatively large, so that there are space restrictions when positioning the mode switching structure. In addition, from the aspect of design, there are considered various locations for the mode hand, the function hands, and also for the external operating member. There is therefore the problem that the above-mentioned mode switching structure gives rise to major restrictions with respect to the timepiece structure.

Accordingly, a second object of the present invention is to provide a multifunctional analogue watch with only minor restrictions in the location of the mode hand and the external operating member, specifically, only minor restrictions in timepiece design, yet providing a highly reliable mode-switching structure.

In addition, in order to satisfy a variety of needs of consumers, analogue electronic watches to which are added a chronograph, a multihand display calendar, a monthly display, and the like are on the market. In some analogue electronic watch of this type, a step motor is designed to turn both forward and in reverse so as to drive the hands sectorially within the display portion.

However, in the case of the electronic watch, a special pulse has to be applied to drive the step motor both forward and in reverse. Specifically, the structure is such that, in one pulse of reverse rotation, initially a forward drive pulse is applied and after the rotor is swung to the forward rotation side, the pulse for reverse use is applied.

In addition, for sector display using the forward and reverse rotations of the step motor, a stopper is always provided in a middle part of the rotary member in order to prevent the hands from moving beyond the specified range due to run away of the circuit chip. Accordingly, a reliable drive is indispensable when the week is revised, even when this stopper has been contacted. However, in the case where the stopper is contacted and the rotor halts, the stopper may prevent the rotation of the rotor in the forward direction depending on the position at which the rotor stops. A situation is therefore reached where reverse rotation is impossible.

Regarding a gear train modification mechanism for an electronic watch with a sector week display of the above-mentioned type, Japanese Patent. Laid-open (kokai) No. 8789/1991, filed by the applicant of the present invention, provides, in order to enable the step motor to escape from a condition in which the reverse rotation is impossible, a rotary member for any one of slowing-down gear trains from the rotor of the step motor to a hand wheel for a sector display section. The step motor forces the rotary member to rotate in the direction to change the rotation to reverse from forward by means of the modifying member which is linked to the external operating member, so that the step motor can rotate to escape from the condition in which reversal is impossible.

However, using the conventional device described above, it is necessary to move the modifying member in the reversing direction of the step motor to extricate the step motor from the condition in which reverse rotation is impossible. Specifically, because the modifying member must be moved to the side at which the rotary member normally acts, there is the possibility of the modifying member entering the normal action range of the rotary member.

Accordingly, even when the hand is acting normally, there is concern that the hand will be inadvertently caused to move due to pressure from the external operating member. In particular, in an electronic watch of the type with two hands provided on the same shaft for a sector display, this method of using the modifying member for the rotation requires two modifying members, making the structure of the timepiece complicated.

A third object of the present invention is to provide a simple modifying mechanism whereby the position of the hands is unaffected, except by the operation for extricating the step motor from the condition in which reverse rotation is impossible.

SUMMARY OF THE INVENTION

The above-mentioned first object is achieved in the present invention by the provision of a structure of the following type.

Specifically, in the wrist watch equipped with a receiving device of the present invention, an antenna is positioned on a display portion of a watch module which is housed in a watch case. The antenna has an antenna winding, wound around an antenna core with the end thereof being fixed, and antenna winding frames at both ends, to which is secured a conductible antenna terminal sheet. The antenna winding frame is inserted into the watch module from the timepiece display section, secured with a screw to an antenna support plate of the watch module, thereby conducting the antenna and the watch module.

The above-mentioned second object is achieved in the present invention by the provision of a structure of the following type.

Specifically, the multifunctional analogue watch related to this invention has a mode-switching structure in which an intermediate mode wheel for driving a mode wheel is provided. The intermediate mode wheel has a plurality of angled sections for appropriately matching the stroke of the mode-switching lever driven by the operation of the external operating member and the stroke of one pitch part of the angled sections of the intermediate mode wheel, thereby performing the conduction between mode-switching patterns corresponding to each mode by means of a mode-switching lever switch spring which rotates together with the intermediate mode wheel.

The above-mentioned third object is achieved in the present invention by the provision of a structure of the following type.

Specifically, a modifying mechanism for a sector display gear train of this invention comprises a hands wheel to which hands are attached, and a rotation regulating projection for regulating the drive of the step motor provided on a part of a slowdown gear train interposed between the step motor and the hands wheel. In addition, a rotation regulation member is provided for regulating the rotation of the step motor when the step motor is driven forward continuously. This rotation regulation member is linked to an external operation member and rotates to cause the step motor to rotate in the forward direction, so that it is possible to change the rotation of the step motor from forward to reverse by an external operation.

DETAILED DESCRIPTION OF THE PREFERRED EMBODIMENTS

The present invention will now be explained with reference to the following embodiments, which are exemplary illustrations of preferred embodiments of the present invention and in no way limitative of the scope of the invention.

An embodiment for achieving the first object of the present invention will now be illustrated with reference to FIGS. 1-5.

Figure 1:
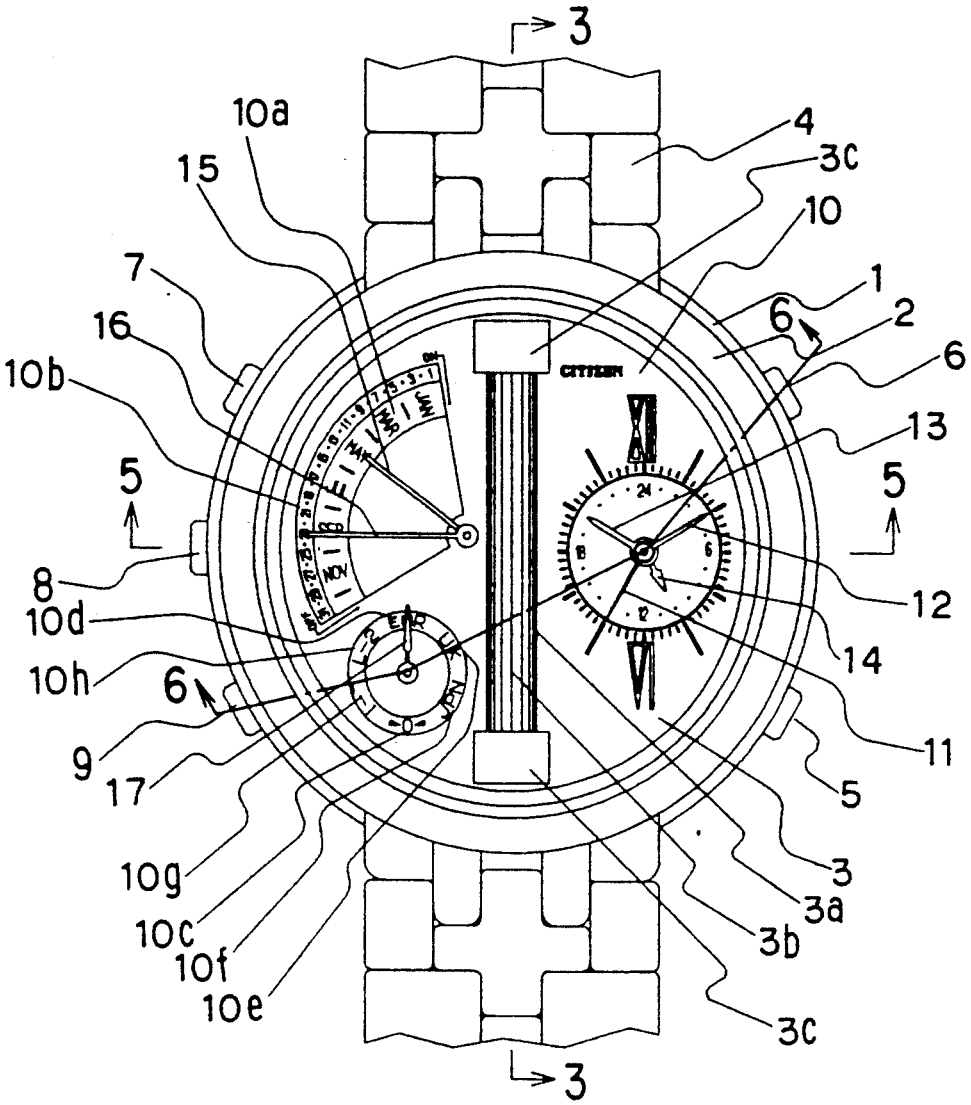
FIG. 1 is a plan view showing an electronic wrist watch equipped with a receiving device which is one of the embodiments of the present invention.

FIG. 1 is a plan view showing an embodiment of an electronic wrist watch equipped with a receiving device of the present invention.

In the Figures, the reference numeral 1 designates a metal watch case; the reference numeral 2 is a bezel made of ceramic and secured by packing (see FIG. 3) to the watch case 1; the reference numeral 3 is a glass windshield; the reference numeral 4 is a metal watch band; the reference numerals 5, 6, 7, 8 are a plurality of push buttons provided on the watch case 1; and the reference numeral 9 is a switch button, which can be pushed and pulled, provided on the watch case 1 in the same manner as the push buttons 5 to 8.

An indented section 3*a* (see FIG. 3, FIG. 4, and FIG. 5) is provided on the undersurface of the glass windshield 3 for housing a later-described antenna extending from the 12:00 o'clock position to the 6:00 o'clock position. In addition, in the indented section 3*a*, a striped pattern 3*b* formed from narrow irregularities, and a pair of vaporization sections 3*c* of vaporized metal for covering a winding frame part of the later-described antenna arranged adjacent to the 12:00 o'clock and 6:00 o'clock positions are provided.

The reference numeral 10 designates a plastic dial with a display section positioned at the left and right boundaries of the indented section 3*a* of the glass windshield 3. On the right side of the display section a second hand 11, a minute hand 12, an hour hand 13, and a 24-hour hand 14 are provided for displaying the time. On the left side of the display section a month hand 15, a day hand 16, and a mode hand 17 are provided. The month hand 15 and the day hand 16 move reciprocally in a uniform range and perform a calendar display at a month display section 10*a* and a day display section 10*b*. The month display section 10*a* and the day display section 10*b* are sectorially shaped so that the display details can be seen easily.

Figures 2A, 2B, 2C, 2D:
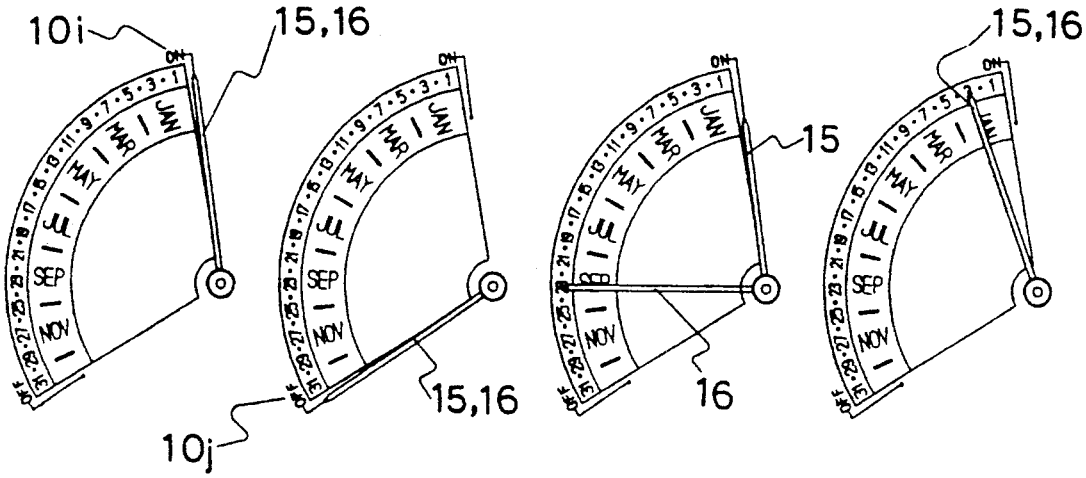
FIG. 2*a* and 2*d* are plan view of the principal parts of the calendar display section shown in FIG. 1, with the display switched to various types of display conditions.

In addition, the display details of the month hand 15 and the day hand 16 are switched, as shown in FIG. 2, to display a radio signal reception condition when receiving radio signals as later described, and display a monitor for showing whether the results of the radio signal reception were normal or abnormal, and in addition, carry out monitor display of summer [daylight saving] time or the like.

The mode hand 17 which is connected to a mode switch terminal of the circuit substrate which corresponds to the various modes, is rotated one mode at a time in the clockwise direction through a later-described mode switching structure of the present invention by pressing the switch button 9, and a mode switch spring (see FIGS. 6, 8, and 9) is also rotated simultaneously. From this operation, the mode selected by the mode hand 17 is displayed and the functions of the various types of modes are selected. Six modes are provided. These are a zero-position mode 10*c* which confirms or resets the standard position for each of the hands 11 to 16; radio-signal-enabling modes 10*d* to 10*f*; and modes 10*g*, 10*h* which can independently set the time.

Here, radio signals are defined as time data transmitted in each country. In this embodiment, Europe, the UK, and Japan are shown by modes 10*d* to 10*f*, and the radio signals for each of these countries can be received, corresponding to the mode display. Here, Europe is the mode 10*d* which is the mode for receiving time data transmitted by Germany.

In the mode which receives these radio signals, in addition to resetting the hands 11 to 16 by the operation of the push buttons 5 to 8 and the switch button 9, there is the function of an automatic receiving state for the specified time, the function of an optional receiving state by the operation of the push button 5. When the radio is normally received, the hands 11 to 16 are automatically reset linked to the radio signal time data. The European mode is selected in the drawing, and a time of 10:10:35 in the morning of May 23 is displayed. In this manner, by the clear understanding of the current timepiece mode from the mode hand 17, the display details of each hand are easily judged, and it is possible to reliably operate the push buttons 5 to 8.

FIG. 2 is a plan view of the principal parts of various types of display conditions with display details switched for a calendar display section shown in FIG. 1. FIG. 2(*a*) shows the radio signal reception condition; FIG. 2(*b*) shows the monitor condition for the result of the radio signal reception; FIG. 2(*c*) shows a monitoring state of the reception results, and FIG. 2(*d*) shows the leap-year setting condition. In FIG. 2(*a*), when the specified time is reached, automatically, or at the reception condition set by the operation of the push button 5, the month hand 15 and the day hand 16 are moved in the clockwise direction, and are stopped at the ON display position 10*i* which shows the reception condition provided on the right side from the first day of the day display section 10*b*. After completion of reception, or when a fixed time reception was not possible, or when reception is stopped from the action of any of the push buttons 5 to 8, the month hand 15 and the day hand 16 return to indicate the month and day displays shown in FIG. 1.

In FIG. 2(*b*), by the operation of the push button 6 under the condition of monitoring the radio signal reception result, when the previous reception was not carried out normally, the month hand 15 and the day hand 16 are moved in the counterclockwise direction, and are stopped at the OFF display position 10*j*, which shows the NG reception condition provided on the left side from the thirty-first day of the day display section 10*b*. When the previous reception was carried out normally, the month hand 15 and the day hand 16 are moved in the clockwise direction, and are stopped at the ON display position 10*i* in the same manner as for the radio signal reception condition in FIG. 2 (*a*).

Further, when the previous reception is normal, the display positions of the month hand 15 and the day hand 16 are the same as for the reception condition in FIG. 2 (*a*), but differentiation is provided in FIG. 2(*a*) by halting the second hand 11 at the zero second position (omitted from the drawing).

In FIG. 2 (*c*), when summer-time is set, in a summer-time monitor condition for monitoring the setting of summer-time by the operation of the push button 7 or in the summer-time conditions when revising the time and calendar from the operation of the push buttons 5 to 8 or the switch button 9, the month hand 15 is stopped at the ON display position 10*j* in the same way as for the radio signal reception condition in FIG. 2(*a*). In addition, when summer-time is not set, the month hand 15 is stopped at the OFF display position 10*i* in the same way as for the reception NG condition in FIG. 2(*b*). (Omitted from the drawing).

In FIG. 2(*d*), leap year is set when revising the time and calendar from the operation of the push buttons 5 to 8 or the switch button 9, or leap year is shown at the ON display position 10*i* from the year data of the received radio wave, at the condition which indicates the elapsing of years from the leap year automatically. The elapsing of one, two, or three years after leap year is indicated at the day one, the day two, the day three of the day display section 10*b*. Either one of these is displayed by the day hand 15 or the month hand 16, with the display being automatically revised at the end of the month. FIG. 2(*d*) shows the condition where three years have elapsed.

In this manner, it is possible to display various functions, as in the case of the present embodiment, by using the hands of an analogue timepiece which can only show a limited display. The arrangement of the sector display for the month hand 15 and the day hand 16 allows a large area for the display and brings about great practical advantage of easy-to-view.

Figure 3:
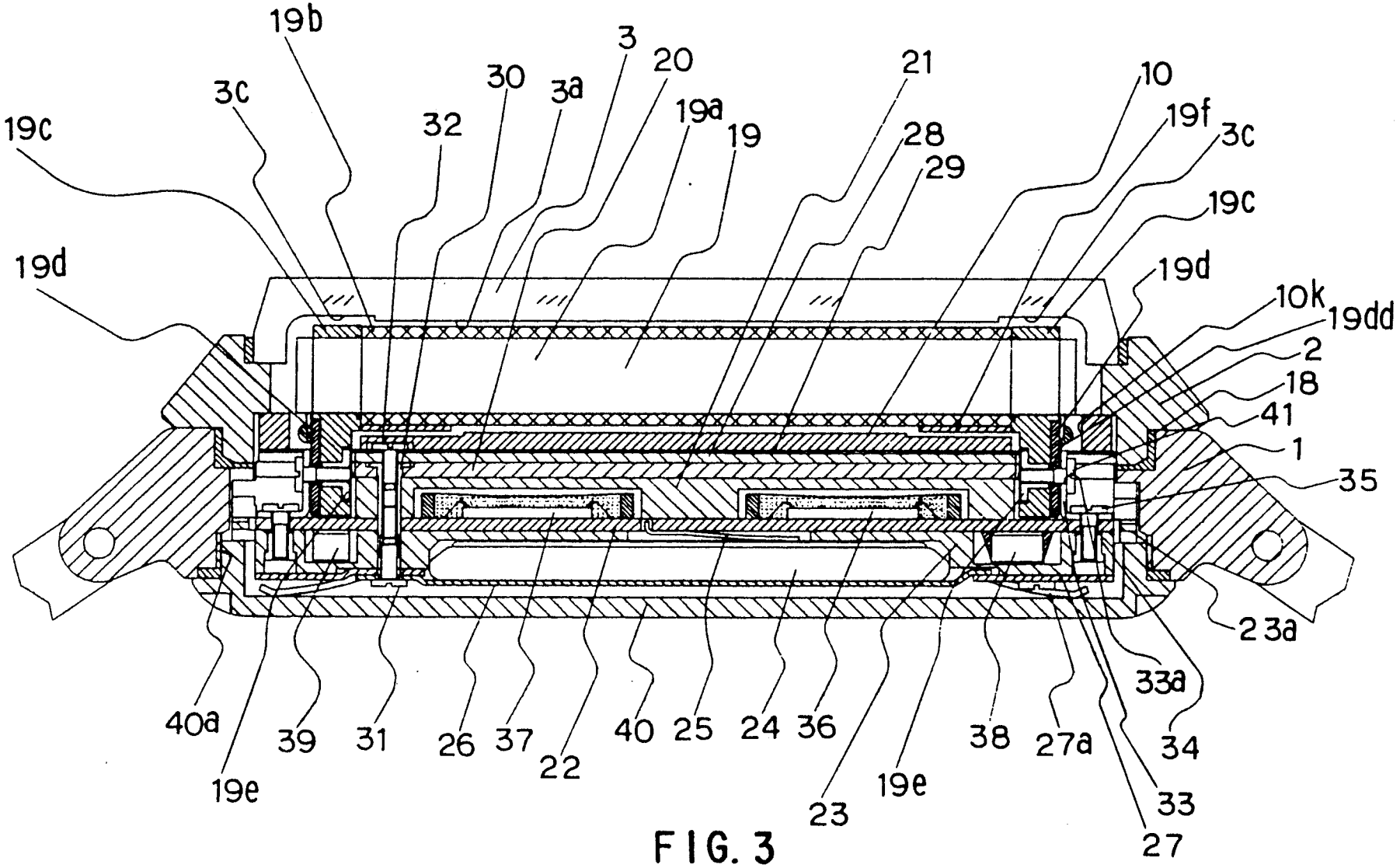
FIG. 3 is a sectional view along the section 3—3 in FIG. 1.
Figure 4:
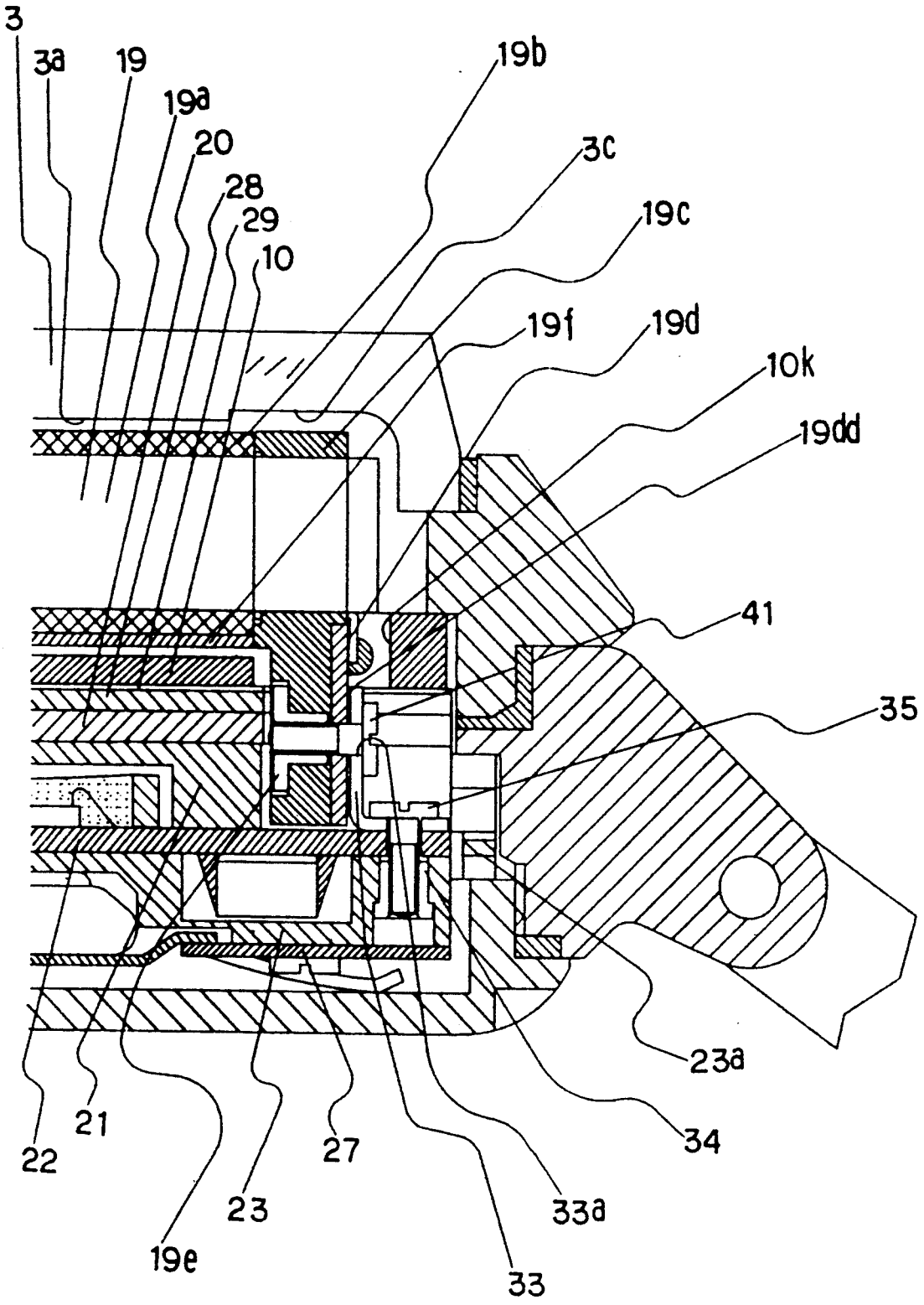
FIG. 4 is an enlarged view of the principal parts of FIG. 3.

FIG. 3 is a sectional view along the section 3—3 in FIG. 1, and FIG. 4 is an enlarged view of the principal part of an antenna mounting part of FIG. 3.

In the drawing, the bezel 2 is secured to the watch case via packing 18. The indented section 3*a* and the vaporization sections 3*c* in the glass windshield 3 as explained in FIG. 1 are formed. The reference numeral 19 designates an antenna comprising an antenna core 19*a* made from ferrite; an antenna winding 19*b* wound around the antenna core 19*a*; a plastic antenna winding frame 19*c* press-fitted into the two end sections of the antenna core 19*a*; an antenna terminal sheet 19*d* glued to the antenna winding frame 19*c*; and an antenna tube 19*e* secured to the antenna winding frame 19*c*.

On the antenna terminal sheet 19*d*, there is a pattern (omitted from the drawings) for soldering the end of the antenna winding 19*b* and a connection pattern (omitted from the drawings) for connecting to a timepiece module, and a hole 19*dd* is provided for securing to the antenna tube 19*e* with a screw.

The antenna 19 is arranged such that the antenna winding 19*b* can be seen from the striped pattern 3*b* of the glass windshield 3, and the antenna winding frame 19*c* cannot be seen since it is screened by the vaporization sections 3*c*. The reference numeral 19*f* designates a gluing section for temporarily securing the end of the antenna winding 19*b* until the soldering is completed.

The timepiece module of this embodiment comprises, as its main structural parts, a metal base plate 20; a plastic circuit holder 21; a circuit substrate 22; a plastic battery support frame 23; a battery 24; a battery receiving spring 25; a battery keep plate 26; a circuit support plate 27; a plastic spacer 28; and a shield plate 29.

A module tube 30, which is one of a plurality of module tubes secured to the base plate 20, positions the base plate 20, the circuit holder 21, the circuit substrate 22, the battery support frame 23, the battery keep plate 26, the circuit support plate 27, the plastic spacer 28, and the shield plate 29, and secures them from the both front and rear surfaces by a pair of screws 31, 32. The spacer 28 and the shield plate 29 are provided to improve the reception characteristics of the antenna, and to prevent the reception characteristics from being affected by the metal base plate 20, the electronic circuit for the circuit plate 22, the hand driving motors, or the like.

The reference numeral 33 designates an L-shaped metal antenna support plate, and the reference numeral 34 designates an antenna securing tube for securing the antenna to the battery support frame 23. The antenna support plate 33 is secured to the circuit substrate 22 by being screwed to the antenna securing tube 34 by a screw 35, and is conducting to a specified circuit pattern (omitted from the drawings). A hole 33*a* is provided for securing the antenna 19 to the antenna support plate 33, and is secured by means of a screw 41.

A first circuit chip 36 and a second circuit chip 37 are provided, and are respectively wire bonded to the circuit substrate 22 and molded with resin. The first circuit chip 36 is an IC with a timepiece function, a function for processing received data and the like. The second circuit chip 37 is an IC with a function for processing received radio signals.

A pair of condenser chips 38, 39 is provided, soldered to the circuit substrate 22, and constitutes the electronic circuitry of this embodiment together with other circuit elements, which are omitted from the drawings, including a crystal oscillator element, a filter oscillator element, a condenser chip, and the like. The reference numeral 40 designates a bottom cover which is secured to the watch case 1 by a screwed section 40*a*. The bottom cover 40 is secured to the timepiece module by contact with a spring section 27*a* of the circuit support plate 27 and a damper section 23*a* of the battery support frame 23.

The process of mounting the antenna 19 will now be explained. The antenna 19 is mounted on the dial 10 on the timepiece module. After the hands 11 to 17 are attached, the antenna winding frame 19*c* is inserted from a notch 10*k* in the dial 10. The screw-accepting hole 19*dd* in the antenna terminal sheet 19*d* is thus lined up with a hole 33*a* in the antenna support plate 33, and the antenna 19 is conducted to the circuit substrate 22 and secured to the timepiece module by means of a screw 41 inserted from the lateral direction of the timepiece module into the antenna securing tube 19*e*.

Taking the reception characteristics into consideration, the cross-section of the mounting position of the antenna 19 secured in this manner is different from that of the watch case 1, and cross-sectionally takes almost the same position as that of bezel 2, thereby eliminating interference of the non-metallic character of the bezel 2 on the reception performance of the antenna 19.

Figure 5:
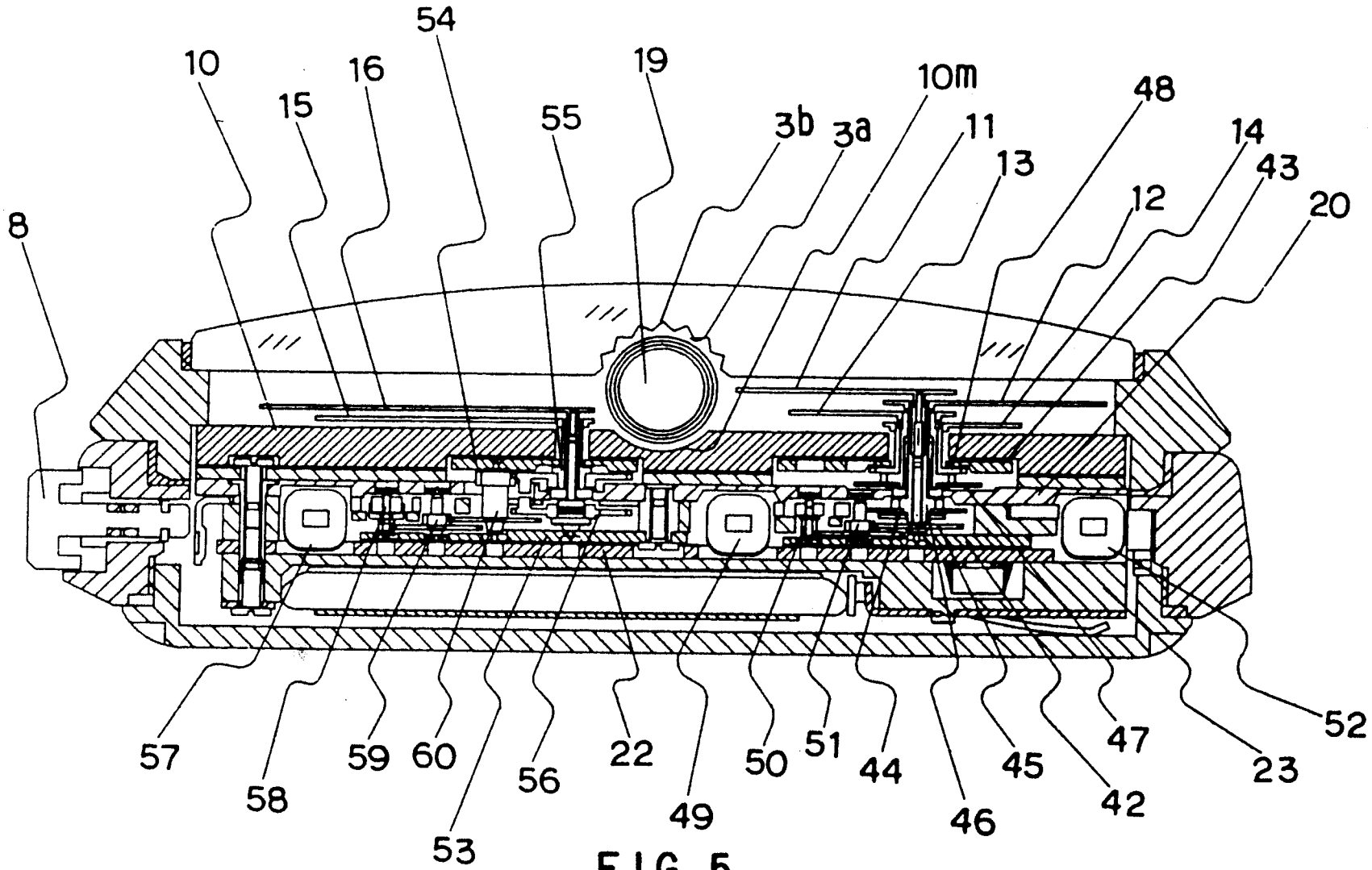
FIG. 5 is a sectional view along the section 5—5 in FIG. 1.

FIG. 5 is a sectional view along the section 5—5 in FIG. 1. The antenna 19 is provided between the indented section 3*a* of the glass windshield 3 and an indented section 10*m* in the dial 10. The antenna 19 is secured with a space between itself and both the glass windshield 3 and the dial 10, so that it does not receive no direct shock from the glass windshield 3 or the dial 10 due to an impact. Therefore, this structure makes it possible to prevent breakage of the antenna core 19*a*. In addition, the space between the glass windshield 3 and the dial 10 is sufficient to mount the hands 11 to 16, thus avoiding the necessity of making the timepiece thick to accept the antenna 19.

As can be clearly understood from the foregoing explanation, in the electronic wrist watch equipped with a receiving device of this embodiment, it is possible to simplify the structure and to reduce the size by installing the antenna on the display section and by making the timepiece module independent, even though the parts for the watch are rather large in comparison with conventional timepiece parts and a consideration must be given to preventing interference with the reception characteristics of the antenna. In addition, because the antenna is not provided in the watch band outside of the watch case, the antenna can be easily conducted to the timepiece module. It is also unnecessary to make this part waterproof, which is a great advantage structurally.

In addition, because the structure is such that the antenna can be mounted after the hands are installed, it is possible to mount the hands without interference from the antenna in the same manner as in the usual type of analogue wrist watch. Also, since the antenna having an antenna core, which not only is large in size and with danger of impact, but also wound with a narrow antenna winding which is easily broken over the outer periphery thereof, is mounted immediately before incorporating into the watch case, an extremely reliable effect is provided in practice to prevent breakage of the antenna.

Also, because the antenna is provided on the dial, it becomes possible to also use a metallic material on the part of the dial in the direction of its thickness other than the location of the antenna. This gives the effect that there are no restrictions as to materials. Further, positioning the antenna on the upper section of the dial, i.e., over the display section, ensures excellent radio signal characteristics. In addition, the installation of the antenna isolated from the timepiece module effectively reduces the influence of the various types of timepiece parts on the reception characteristics.

Beside, providing the antenna in the watch case eliminates the need for a special watch band, making it possible to use a metal watch band. In addition, the restrictions as to a large-sized antenna in relation to the flat profile of the timepiece can be removed by laying the antenna in a flat plane on the display section, which brings about the effect of reducing restrictions from the aspect of design.

An embodiment for achieving the above-mentioned second object of the present invention will now be explained with reference to FIGS. 1, 6, 7, 8, and 9.

Figure 6:
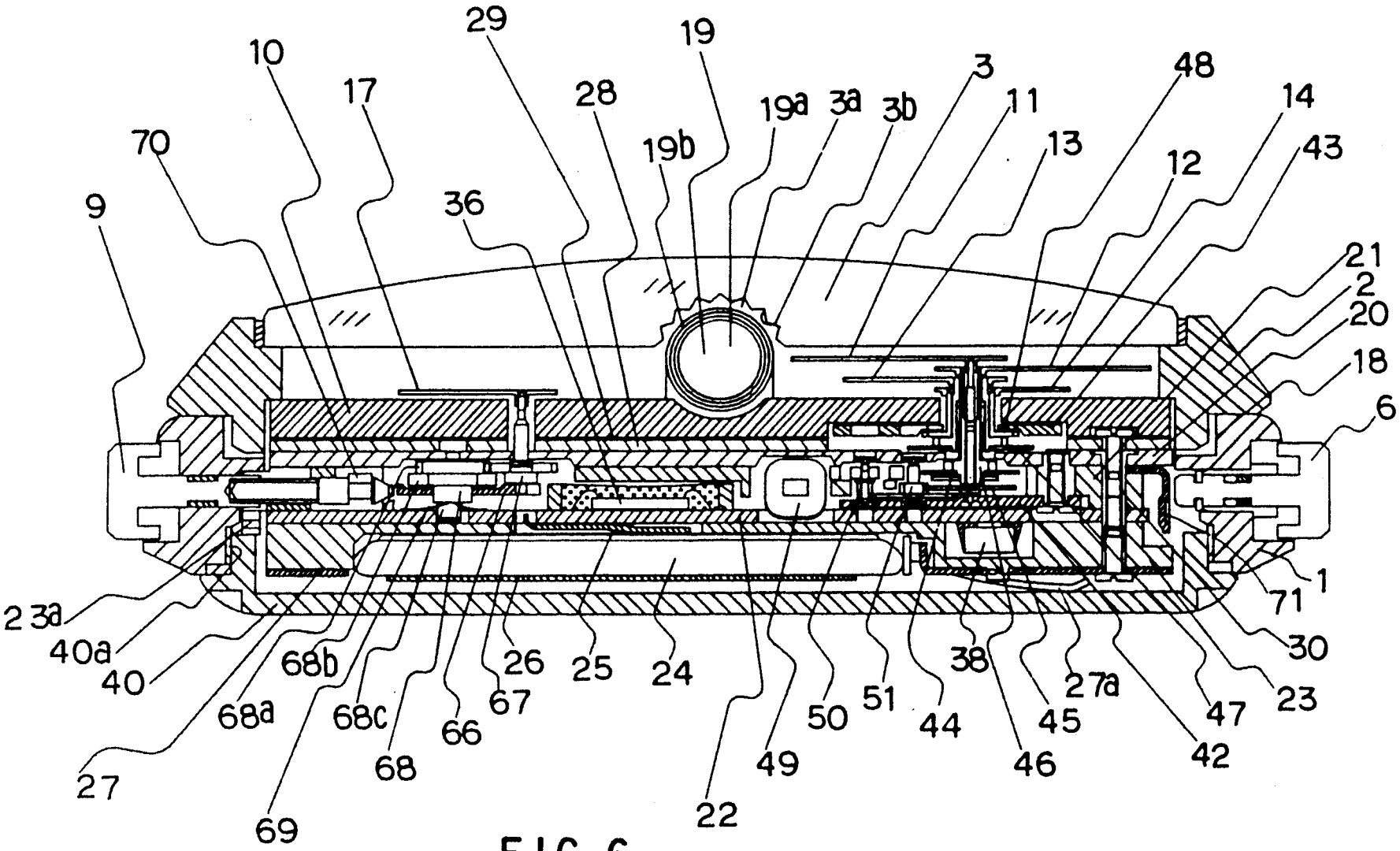
FIG. 6 is a sectional view along the section 6—6 in FIG. 1.

FIG. 6 is a sectional view along the section 6—6 in FIG. 1.

In the drawing, the reference numeral 42 designates a gear train receiver, the reference numeral 43 is a bottom plate, and the reference numeral 44 is a middle receiver. The various types of receivers support various gears for the time display gear trains such as a second wheel 45 on which is mounted the second hand 11, a backing wheel 46 on which is mounted the minute hand 12, a tubular wheel 47 on which is mounted the hour hand 13, a second tubular wheel 48 on which is mounted the 24-hour hand 14, and the like, together with the base plate 20 (See FIG. 7). The reference numeral 49 designates a second coil, comprising a timepiece converter which drives a second rotor 50 and drives the backing wheel 45 through a second intermediate wheel 51. The reference numeral 52 designates a time coil for driving a time gear train for the backing wheel 46, the tubular wheel 47, and the second tubular wheel 48, and the like.

The reference numeral 53 designates a calendar gear train receiver, and the reference numeral 54 is a calendar bottom plate. The calendar gear train receiver 53 and the calendar bottom plate 54 support various gears for the calendar display gear trains such as a month wheel 55 on which is mounted the month hand 15, and a day wheel 56 on which is mounted the day hand 16, and the like (See FIG. 7). The reference numeral 57 designates a month coil for driving a month rotor 58, and for driving the month wheel 55 through a first intermediate month wheel 59 and a second intermediate month wheel 60. In the same manner, a day coil (omitted from the drawing) drives a day gear train (also omitted from the drawing) for the day wheel 56 and the like, provided separately. Gear train structures of this type can independently drive the second hand 11, the minute hand 12, the hour hand 13, the 24-hour hand 14, the month hand 15, and the day hand 16, respectively.

The reference numeral 66 designates a mode gear train receiver. The gears of a mode display gear train of a mode wheel 67 on which the mode hand 17 is mounted and an intermediate mode wheel 68 which engages the mode wheel 67 are supported together with the base plate 20. The intermediate mode wheel 68 is provided with a gear section 68*a* for engaging the mode wheel 67, an angled section 68*b* for engaging a later-described mode-switching lever when the mode is switched, and a D-shaped, irregularly-formed shaft section 68*c* (see FIG. 7) on which a mode-switching spring 69 is fitted.

The angled section 68*b* normally engages a later-described jumper section and positions the intermediate mode wheel 68 in the rotary direction. The mode-switching spring 69 is fabricated from a thin metal plate and contacts the circuit substrate 22, bent between the circuit substrate 22 and the intermediate mode wheel 68. It rotates together with the intermediate mode wheel 68 and is connected to a plurality of mode switch terminals (omitted from the drawing) corresponding to the various modes. Here, although the mode wheel 67 is located adjacent to the circuit chip 36, the intermediate mode wheel 68 is separated from the circuit chip 36, thus ensuring mounting of the mode-switching spring 69 without influence on the installed section of the circuit chip 36.

The reference numeral 70 designates a setting lever which rotates around a setting lever shaft provided on a later-described base plate and engages the switch button 9. The setting lever 70 is positioned in a specified position by bottom restraint. The reference numeral 71 designates a first return spring provided with a spring section which slides between the base plate 20 and the circuit holder 21, imparting the spring force to the push button 6. Its tip section bent into an L-shape is connected to a switch pattern (omitted from the drawing) on the end surface of the circuit substrate 22 through the action of the push button 6 and carries out a specified switch operation.

Figure 7:
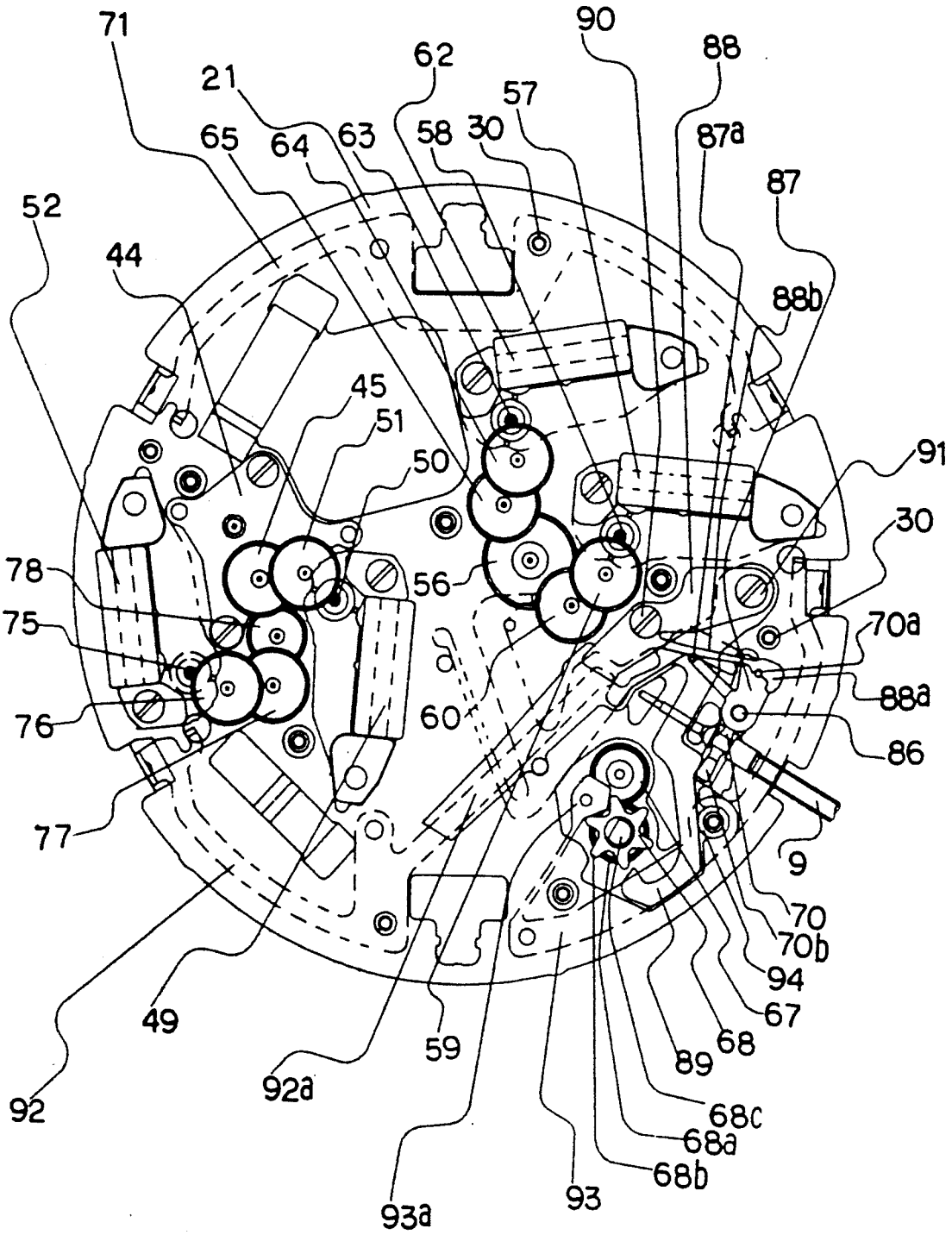
FIG. 7 is a plan view of a timepiece module illustrated in FIG. 1.

FIG. 7 is a plan view, viewed from the bottom cover 40 side, of a timepiece module, and shows the circuit substrate 22, the battery support frame 23, the battery keep plate 26, the circuit support plate 27, the gear train receiver 42, a calendar gear train receiver 53 (See FIG. 5), and the mode gear train receiver 66, for a state in which each gear train receiver is set aside.

The circuit holder 21 covers almost the entire surface of the drawing, and in the same manner as for the second coil 49 which forms a timepiece converter for driving the second wheel 45, explained in FIG. 6, a time coil 52, the month hand 15, and the day hand 16 which form the timepiece converter for driving the time gear train of the backing wheel 46, the tubular wheel 47, the second tubular wheel 48, and the like, are respectively provided.

The reference numerals 75 to 78 designate a plurality of gears of a time gear train, and the reference numerals 63 to 65 designate a plurality of gears of a calendar gear train.

The reference numeral 86 designates a setting lever shaft secured to the base plate 20; the reference numeral 87 is a switch spring provided on the setting lever 70; and the reference numeral 88 is a setting lever spring. The setting lever 70 and the switch spring 87 are provided in a freely rotatable manner on the setting lever shaft 86. The switch spring 87, which is provided with a spring section 87*a* for operating the switch, rotates together with the setting lever 70, positioned by means of a projecting section 70*a* of the setting lever 70 for engaging a switching section 88*a* of the setting lever spring 88.

The reference numeral 89 designates a mode switching lever provided between the setting lever spring 88 and the circuit holder 21. A screw 91 of a pair of screws 90, 91 for securing the setting lever spring 88 can rotate around a screw-secured tube 96 (see FIG. 8). The mode switching lever 89 engages a tip section 70*b* of the setting lever 70 at almost the longitudinal center of the mode switching lever 89, and the tip section 70*b* engages an angled section 68*b* of the intermediate mode wheel 68 during the operation of the switch button 9.

In the present embodiment, the gear section 68*a* of the intermediate mode wheel 88 has the same number of gears as the mode wheel 67 and rotates at the same rate as the mode wheel 67 and the intermediate mode wheel 68, while the angled section 68*b* has six chevrons. Here, if the diameter of the angled section 68*b* of the intermediate mode wheel 68 is 3 mm and there are six modes, the movement of the intermediate mode wheel 68 for each mode is about 1.5 mm, and, when the spring-up position of the spring-up lever is taken into account, it is necessary that the intermediate mode wheel be moved about 1 mm in one mode switching.

The stroke of the switch button 9 is normally about 0.3 to 0.5 mm. Because of this, it is necessary for the intermediate mode wheel 68 to be driven by a member which has a stroke two or three times that of the switch button 9. A structural arrangement is thus necessary so that a suitable lever ratio can be taken. As shown in this embodiment, the switch button 9, the intermediate mode wheel 68, setting lever 70, and the mode switching lever 169 are structurally arranged so that it is possible to ensure the lever ratio for obtaining the necessary stroke on the mode switching lever 89, regardless of the position of the intermediate mode wheel 68 relative to the position of the mode wheel 67.

In this embodiment, the adjacent positioning of the mode wheel 67 to the switch button 9, and the adjacent positioning off the converter for the month coil 73 to the calendar gear train can be major restrictions to the mode switching structure. However, this structural arrangement is comparatively flexible, since this structure does not drive the mode wheel 67 directly by the lever.

A structure by which the mode wheel 67 is directly driven can be considered. However, in the structure where the mode wheel 67 is positioned adjacent to the switch button 9, as shown in the drawing, it is difficult to ensure the lever ratio for obtaining the necessary stroke for mode switching. A method of making structure of the mode wheel small for reducing the stroke necessary for mode switching, or a method to increase the lever ratio for the mode switching lever can also be considered. These method, however, involves structural problems or difficulties in obtaining the necessary precision of the parts in actual practice.

The reference numerals 92, 93, indicated by broken lines, designate a second return spring and a third return spring of the same type as the first return spring 71. The second and third return springs 92, 93 are provided between the base plate 20 and the circuit holder 21. They provide the spring force to the push buttons 5, 8, and contact the circuit substrate 22 to provide an ON/-OFF switch action through an electrical contact. The first return spring 71 is shaped such that it engages not only the push button 6 but also the push button 7.

In addition to its original function, the tip of the second return spring 92 contacts the mode switching lever 89 to rotate the mode switching lever 89 in the counterclockwise direction. The second return spring 92 is also provided with a return spring section 92*a* which is in contact with a positioning tube 94 of the mode gear train receiver 66. In addition, the third return spring 93 is provided with a jumper 93*a*, which engages the angled section 68*b* of the intermediate mode wheel 68 and positions the intermediate mode wheel 68 in the rotary direction. Further, the reference numeral 30 designates the module tube, which was explained with reference to FIG. 3. The two out of four of them position the first and second switch return springs 92, 93.

Figure 8:
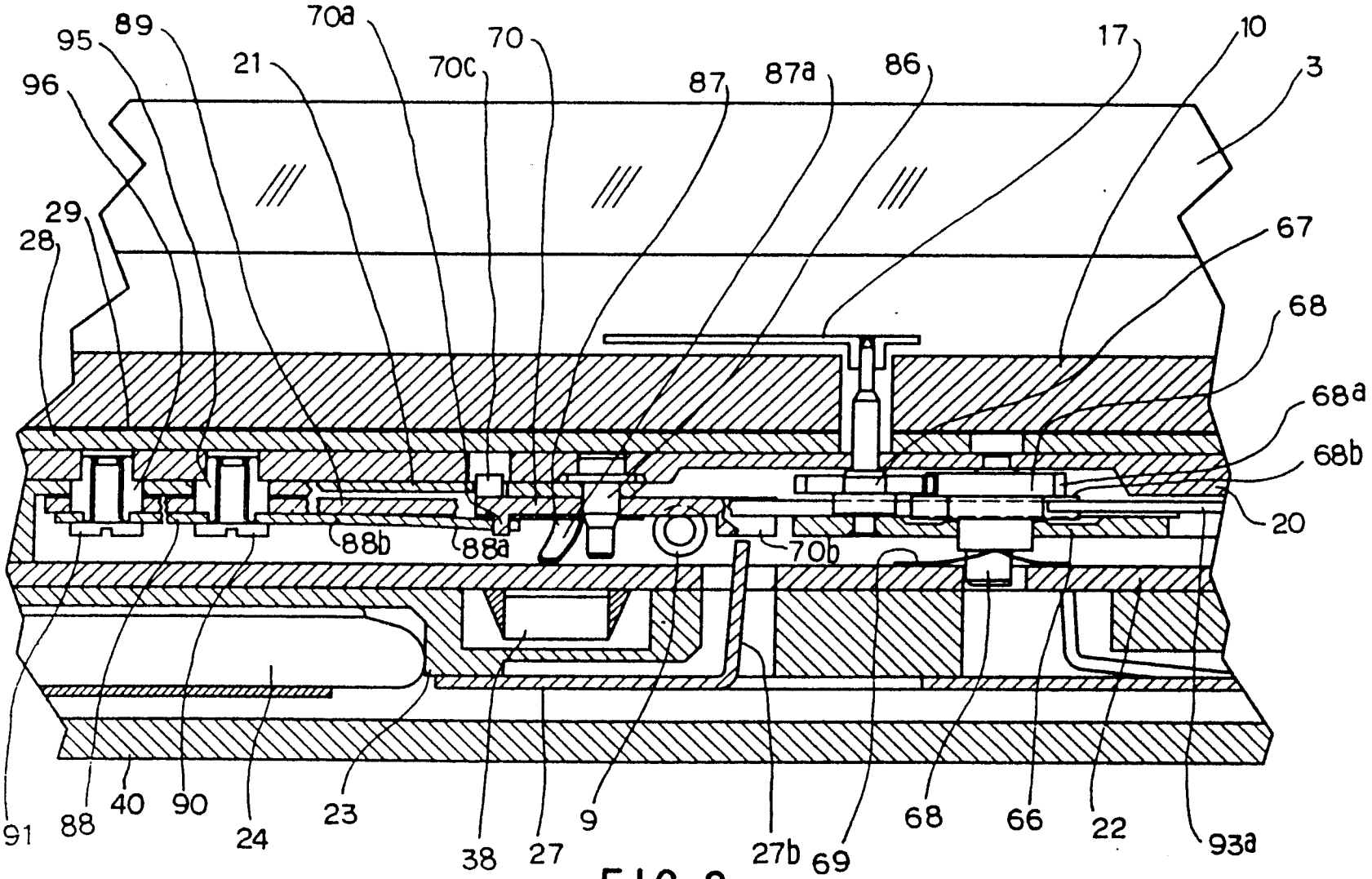
FIG. 8 is a sectional view of the principal parts of FIG. 1.

FIG. 8 is a sectional view of the principal parts of a structure which rotates in reverse when compared with this embodiment.

The setting lever shaft 86 and a pair of tubes 95, 96, which fixes the setting lever spring 88 by screws, are secured to the base plate 20. The spring section 87*a* of the switch Spring 87 is bent to contact the circuit substrate 22. The switch spring 87 rotates with the setting lever 70, and performs an ON/OFF operation through a switch element (omitted from the drawing) provided on the circuit substrate 22. The setting lever spring 88 not only positions the setting lever 70, but also its spring section 88*b* presses the setting lever 70 and the switch spring 87 against the circuit holder 21 so as to engage the setting lever 70 with the switch button 9.

The mode switching lever 89 is able to rotate between the circuit holder 21 and the setting lever spring 88, centered around the tube 96, as explained in FIG. 7, and contacts the tip 70*b* of the setting lever 70.

A spring section 88*b* is provided on the circuit support plate 27 for operating the setting lever 70 when the switch button 9 is disconnected from the timepiece module.

The operation of the mode switching structure will now be explained.

Figure 9A:
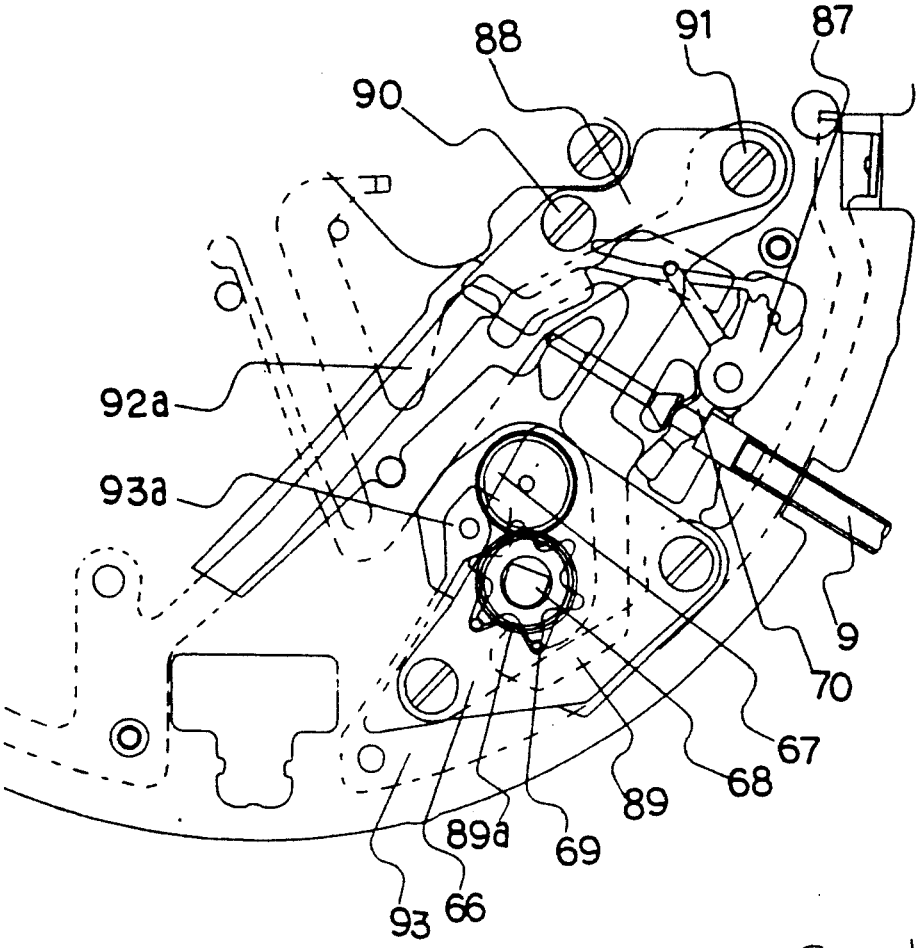
FIG. 9 (A) and FIG. 9 (B) are diagrams illustrating the operation of the second embodiment of the present invention.
Figure 9B:
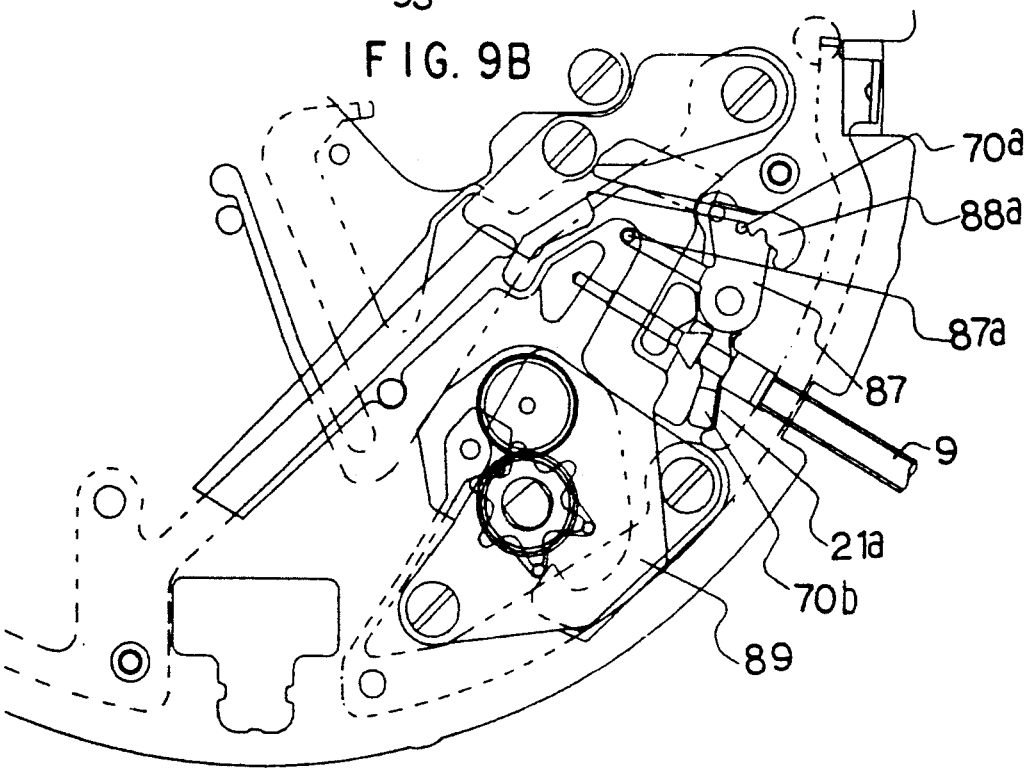

FIG. 9 is an operational diagram for the main parts of the mode switching structure of the present invention. FIG. 9(A) shows the switch button 9 in the depressed state; FIG. 9(B) shows the switch button 9 in the unrepressed state.

In FIG. 9 (A), when the switch button 9 is depressed from the normal state shown in FIG. 7, the setting lever 70 rotates in the clockwise direction around the setting lever shaft 86. As a result, in the same manner, the mode switching lever 89, which contacts the tip 70*b* of the setting lever 70, rotates while bending the return spring section 92*a* of the second switch return spring 92 rotates, and the tip 89*a* contacts the angled section 68*b* of the intermediate mode wheel 68 so that the intermediate mode wheel 68 is caused to rotate.

The angled section 68*b* strikes against the jumper 93*a*, and on overcoming this, rotates by the spring force, makes a 60° rotation equivalent to one-chevron, and, once again is stopped to bring the intermediate mold wheel 68 in a stable position by the jumper 93*a*. As a result, the mode switching spring 69, which rotates together with the intermediate mold wheel 68, is connected to the mode switch pattern (not shown in the Figure) corresponding to the selected mode to change the details of the function. The mode wheel 67 is also rotated for one mode by the gear 68*a* of the intermediate mold wheel 68, and the mode hand 17 indicates one of a plurality of specified mode display sections 10*c* to 10*h*.

Following this, if the operation of the switch button 9 is canceled, the setting lever 70 and the mode switching lever 89, together with the switch button 9, return to the normal state shown in FIG. 7, by the spring force of the return spring section 92*a* and the spring force of the setting lever spring 88 through the setting lever 70. In this manner, by depressing the switch button 9, the intermediate mold wheel 68 and the mode switching spring 69 rotate one chevron, and the mode wheel 67 also rotates one mode.

In FIG. 9(B), when the switch button 9 is pulled out from the normal state illustrated in FIG. 7, the setting lever 70 rotates counterclockwise. In this state, the rotation of the setting lever 70 is regulated by the tip 70*b* of the setting lever 70 and the stopper section 21*a* of the circuit holder 21, thereby maintaining the setting lever 70 in a state wherein the switch button 9 is in the pulled-out state by the projecting section 70*a* of setting lever 70 and the positioning portion 88*a* of the setting lever spring 88.

In this state, the spring section 87*a* of the switch spring 87 rotating together with the setting lever 70 contacts the specified switch pattern (not shown in the drawings) of the circuit substrate 22, and the hands 11 to 16 are put in the modified state by the push buttons 5 to 8. On the other hand, the mode switching lever 89 remains in the normal state, and the mode wheel 67 and the intermediate mode wheel 68 are maintained in this state.

As can be clearly understood from the foregoing explanation, as a result of a mode-switching structure wherein the mode is changed by using the external operating member by driving the mode wheel on which the mode hand is mounted via the intermediate mode wheel, the multifunctional analogue wrist watch of the present embodiment can be applied to various timepiece designs in terms of positional relationship between the mode hands and the external operating members, such as a design in which the mode, hand and the external operating members are brought close together or a design in which the mode hands and the external operating members are installed apart from each other.

In addition, since the intermediate mode wheel is driven by the mode switching lever linked to the external operating member, it is possible, in the operation of the external operating member with a fixed stroke restriction, to arrange the intermediate mode wheel at a position at which driving is possible with no relation to the position of the mode hand, with a suitable lever ratio for the mode switching lever. This makes it unnecessary to make the mode wheel to be extremely small or to make the lever ratio to be unreasonably large, ensuring a high reliability of the device and a major structural benefit.

Furthermore, the angle of rotation of the mode wheel for one step of the intermediate mode wheel can be changed by changing the gear ratio between the mode wheel and the intermediate mode wheel, so that changing the number of modes can be simplified. This enables the arrangement to be applied to various multifunctional analogue watches.

An embodiment for achieving the third object of the present invention will now be explained with reference to the FIGS. 1, 10, and 11.

The segment display gear train mechanism and the modifying mechanism for the month hand 15 and the day hand 16 will be explained with reference to FIG. 10 and FIG. 11. First, the gear train mechanism will be illustrated with reference to FIG. 10, which is a plan view of the principal parts of a modifying mechanism of a timepiece sector display gear train viewed from the bottom cover side, and FIG. 11, which is a sectional view of the sector display gear train.

A month coil 57, a month rotor 58, and a month yolk 61 constitute a month step motor, for driving for sectorial display of the month hand 15 under the electric control by the circuit chip 36.

The month rotor 58 is bearingly supported by a base plate 20, which is a timepiece holder, and by a jewel secured to a gear train receiver 53. The month yoke 61 and the month coil 57 are laminated onto the upper surface of the base plate 20. The drive power of the month wheel 55 on which the month hand 15 is mounted is transmitted by the month rotor 58 through a first intermediate month wheel 59 and a second intermediate month wheel 60 which together form a slowing-down gear train. The first intermediate month wheel 59 is bearingly supported by a bottom plate 20 and the jewel which is secured to the calendar gear train receiver 53, in the same manner as for the month rotor 58. The second intermediate month wheel 60 is bearingly supported by the calendar gear train receiver 53 and the calendar bottom plate 54.

The month wheel 55 comprises a month wheel core 55*a* on which the month hand 15 is mounted, and a month gear 55*b* made from synthetic resin for receiving the rotational force. The month gear 55*b* is integrally formed with a projection 55*c* for rotation regulation, which is cross-sectionally layered over a differently shaped elongated hole 20*a* made of a synthetic resin and formed in the base plate 20 and functions as a stopper when the rotation of the month wheel 55 is regulated.

The gear train mechanism on the day hand 16 side is formed in the same manner as the gear train mechanism on the month hand 15 side. A day step motor is constructed by a day rotor 63, a day coil 62, a day yoke 72. The reference numeral 56 designates a day wheel; the reference numeral 56*a* is a day wheel core; and the reference numeral 56*b* is a day gear. In addition, the reference numeral 64 designates a first intermediate day wheel; and the reference numeral 65 is a second intermediate day wheel. A projection 56*c* for rotation regulation is also integrally formed on the day gear 56*b* in the same manner as that on the month gear 55*b*.

The projection 55*c* (a controlled member) provided for rotation regulation on the month gear 55*b* and the projection 56*c* (a controlled member) provided for rotation regulation on the day gear 56*b* move reciprocatingly inside the differently shaped elongated hole 20*a* in the base plate 20 without contacting any other parts, as the result of a positioning operation by the circuit chip 36 carried out directly after the insertion of a battery, thereby fixing the month hand 15 and the day hand 16 at specified places in this state.

In addition, a rotation regulating member 195 is disposed between the base plate 20 and the circuit supporting plate 21 at a position where it does not overlap with the gear train. The rotation regulating member 195 is provided with a rotation regulation section 195*a* bent in a shape of character L and inserted in the elongated hole 20*a*. The position regulation of the rotation regulating member 195 in the plane is carried out, around the supporting column 99 embedded in the base plate 20 as a rotation axis, by the reaction force of a spring section 195*c* of the rotation regulating member 195 against a support column 196 erected on the base plate 20. In this manner, the forward rotation regulation of the step motor is performed with the rotation regulation projections 55*c* and 56*c* on the month gear 55*b* and the day gear 56*b* respectively applied to a rotation regulating section 195*a* of the rotation regulating member 195.

Figure 10:
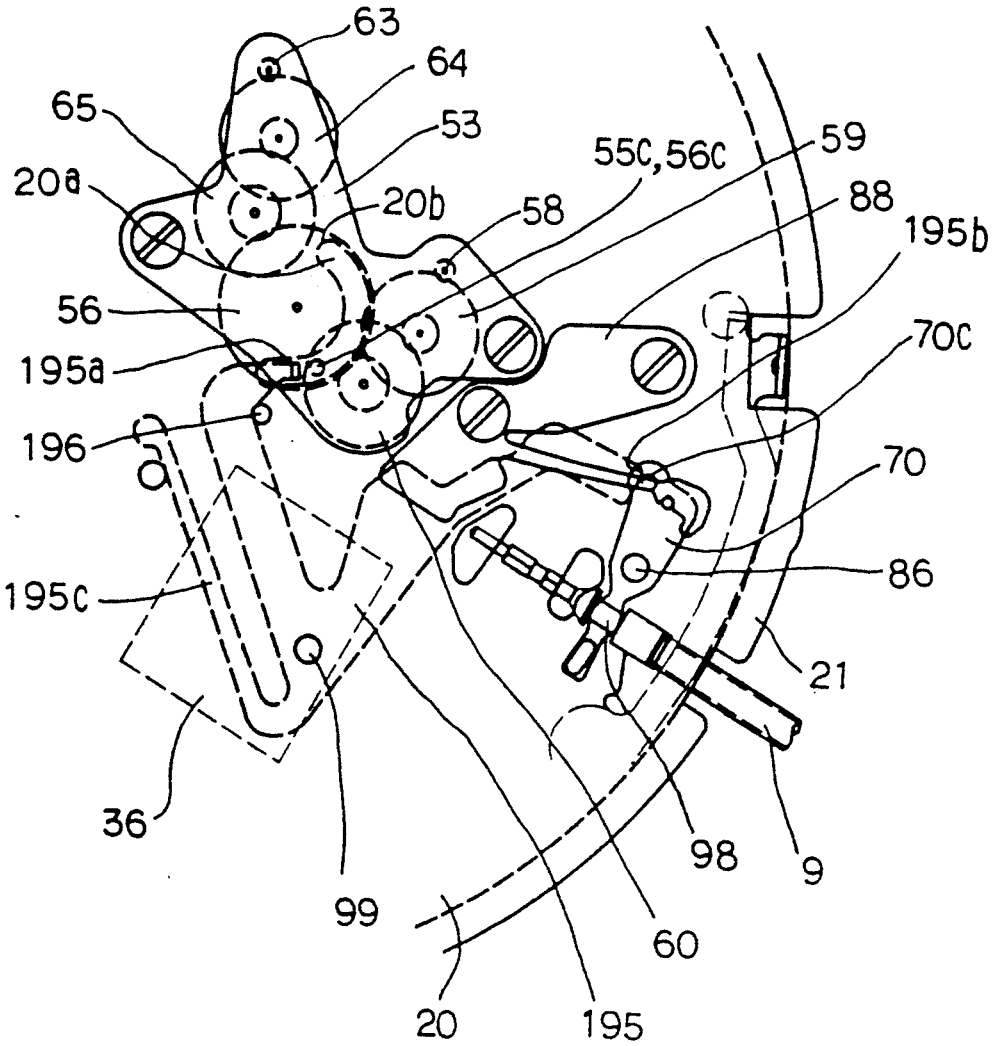
FIG. 10 is a plan view of the principal parts showing a modifying mechanism of a timepiece sector display gear train of the third embodiment in the present invention.
Figure 11:
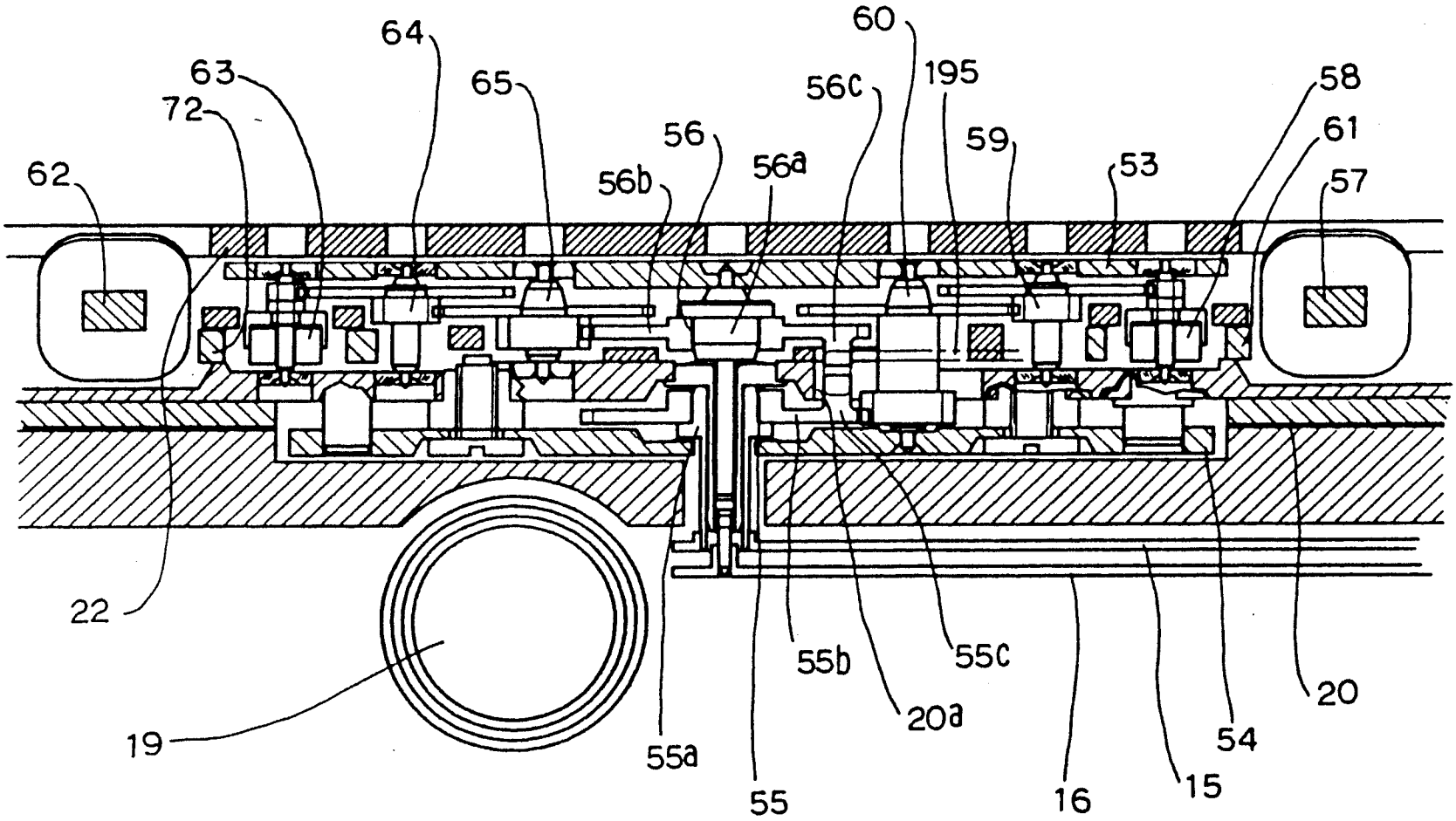
FIG. 11 is a sectional view of the timepiece sector display gear train of the third embodiment of the present invention.

In the present embodiment, the forward rotation of the step motor means the counterclockwise rotation of the month rotor 56 and the day rotor 63 in FIG. 10. Conversely, the regulation for the step motor to rotate in the reverse direction is carried out with the rotation regulation projections 55*c* and 56*c* on the month gear 55*b* and the day gear 56*b* respectively applied to an end section 20*b* of the differently shaped elongated hole 20*a* in the base plate 20. Accordingly, the month hand 15 and the day hand 16 do not move beyond the specified range and do not come in contact with the adjacent antenna 19, even if the circuit chip 36 were to go out of control.

In the cross-sectional relationship between the circuit chip 36 and the rotation regulating member 195, the rotation regulating member 195 is positioned on the upper surface of the base plate 20, over which is provided a circuit holder 21 formed of synthetic resin with a space necessary for the rotation regulating member 195 to slide. In addition, the circuit chip 36 which is mounted on the back of a circuit substrate 22 is arranged over the circuit holder 21.

The operation of the modifying mechanism will now be explained. The circuit chip 36 is supposed to go out of control, causing the step motor to rotate continuously in the forward direction, and causing the rotation regulation projection 55*c* or 56*c* on the month wheel 55 or the day wheel 56 respectively to collide with the rotation regulating section 195*a* of the rotation regulating member 195 and to halt their movement, so that their reverse rotation becomes impossible. Since this sort of non-reversible state is caused by the malfunction of the circuit chip 36, it is necessary that the circuit chip 36 be initialized. For such an operation, the watch of this embodiment requires to simultaneously press the push buttons 5, 6, 7, and 8. This operation causes the month rotor 58 and the day rotor 63 to rotate in reverse direction by an electrical signal from the circuit chip 36, so that they are driven to their initial positions. The state of the rotor incapable of reversely rotating can be released by the rotation regulation section 195*a*.

During the above-described series of operations, when the switch button 9 is pulled out, a winding core 98 integrally formed with the switch button 9 is also pulled out, causing the setting lever 70 to rotate with the setting lever axis 86 erected on the base plate 20 acting as the axis of rotation. A projected section 70*c* (see FIG. 8) provided on the base plate 20 side of the setting lever 70 rotates counterclockwise, pressing the end section 195*b* of the rotation regulating member 195. Accordingly, the rotation regulating section 195*a* of the rotation regulating member 195, which acts as the axis of rotation of a support column 99 erected on the base plate 20, rotates in the counterclockwise direction, shifting the rotation regulating section 195*a* toward the left from the position shown on the drawing. This shifting to the left releases the collision of the rotation regulation projection 55*c*, 56*c*, and the rotation regulation section 195*a*, and thereby releases the month and day step motors 14 and 23, enabling the rotor to rotate in the forward direction to the extent that it is not attracted to a next stable point required for the reverse rotation.

As can be clearly understood from the above explanation, in the present embodiment, the rotation regulation projections do not contact the rotation regulating member except when the rotor is entrapped in the state where it is impossible to reverse. Therefore, a modifying mechanism can be provided which does not affect the position of the hands. Furthermore, because no pressure is applied directly to the gear train parts, there is no damage caused to these gear train parts.

In addition, even with a timepiece with a segment display provided with two hands on the same shaft, as in the third embodiment of the present invention, the effect of being able to escape from a condition impossible to reverse is provided with a simple configuration.

The structure of a reset switch for a chip circuit containing a microcomputer will now be explained with reference to FIG. 12 to FIG. 18.

In the structure for the reset switch of the present invention, a battery holding spring is positioned so as to be simultaneously connected to a battery and to both sides of a reset terminal, with the microcomputer connected to the chip circuit. Specifically, when the battery is installed in the electronic watch and the battery holding spring is moved to a specified position to securely hold the battery, the battery holding spring contacts the reset terminal of the chip circuit, following which the battery is held securely. When the battery holding spring contacts .the reset terminal of the chip circuit, there is a short circuit between the power source terminal and the reset terminal of the chip circuit so that the chip circuit is reset. In this manner, according to the present invention the microcomputer can be initialized automatically and reliably merely by normally inserting the battery.

Figure 12:
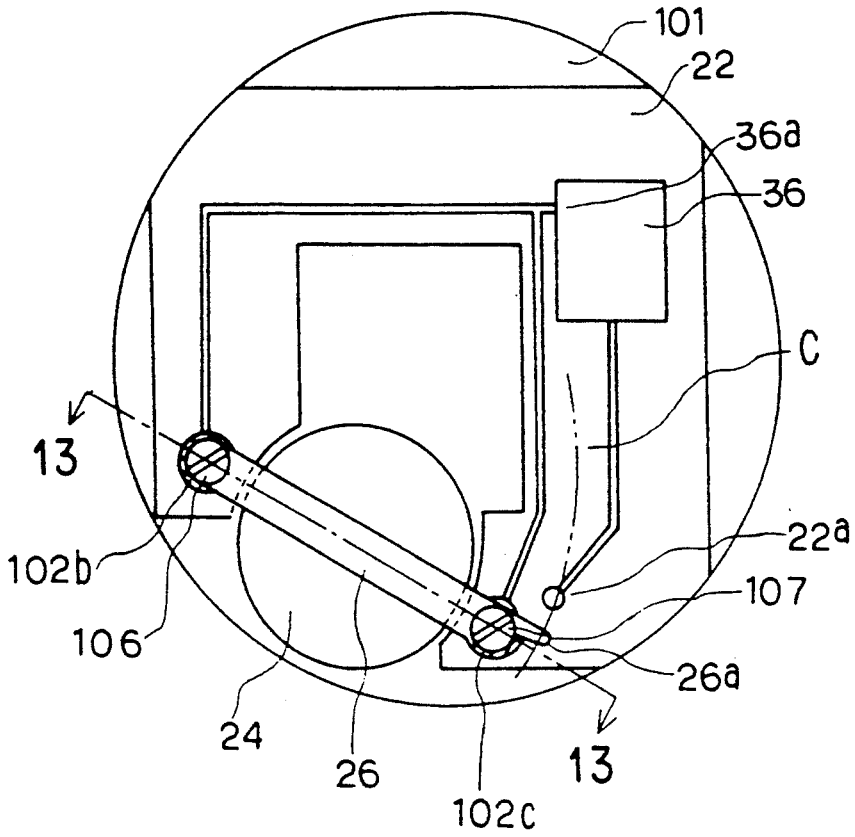
FIG. 12 is a plan view of the reset switch structure in the first embodiment.

As illustrated in FIG. 12, the reset switch comprises the base plate 101 of the watch, the circuit substrate 22 to which the battery keep plate 26 is connected and on which a circuit chip 36 is mounted, and the battery 24. The battery keep plate 26 is provided with an extended section 26*a* and secures the battery 24 by means of a pair of holding screws 106, 107. A reset terminal 22*a* and a pair of power terminals 102*b*, 102*c* are connected to the chip circuit 36 and the like on the circuit substrate 22.

Figure 13:
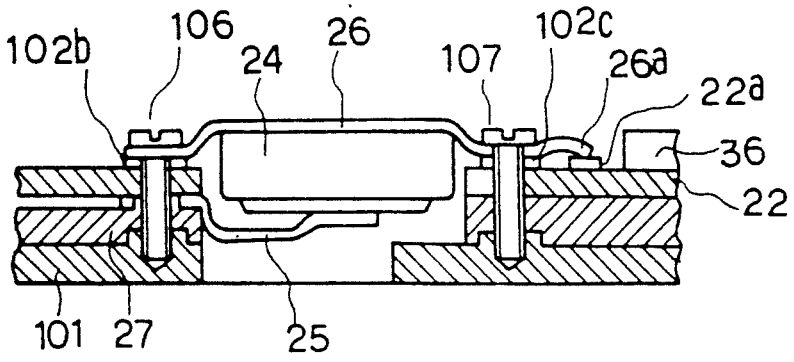
FIG. 13 is a sectional view along the section 13—13 of FIG. 12.

This configuration will now be explained in more detail with reference to FIG. 13 which is a cross-sectional view taken along the section 13—13 in FIG. 12.

The power terminals 102*b*, 102*c* are connected to a VDD 36*a* which is the plus side of the power terminal of the circuit chip 36 on the circuit substrate 22. The battery keep plate 26 is connected to the power terminals 102*b*, 102*c* by a pair of holding screws 106, 107, and also contacts the plus electrode of the battery 24. The minus electrode of the battery 24 is contacted by the battery receiving spring 25 as a result of this pressure.

The battery receiving spring 25 is insulated from the holding screw 106 by means of the circuit support plate 27 which is formed from an insulating material such as plastic or the like, and is connected to a minus side power terminal VSS (omitted from the drawing) for the chip circuit 36 on the back of the circuit substrate 22. The battery receiving spring 25 is formed so that it presses the battery 24 from the bottom in order to provide electrical contact with the battery 24.

The battery keep plate 26 can be rotated around the holding screw 106 by loosening the holding screws 106, 107. A reset terminal 22*a* is positioned on the circle drawn by the tip of the extended section 26*a* of the battery keep plate 26; i.e., on the chain line C (connecting double semisolid sequences), and when the battery keep plate 26 is rotated around the holding screw 106 the extended section 26*a* slides to contact the reset terminal 22*a*.

The operation of the reset switch will now be explained, based on FIG. 14.

Figure 14A:
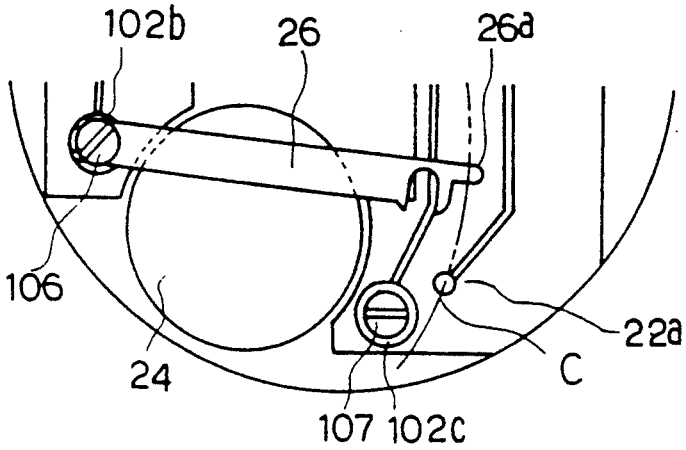
FIGS. 14 (*a*), and 14 (*c*) are a view illustrating the operation of the first embodiments.
Figure 14B:
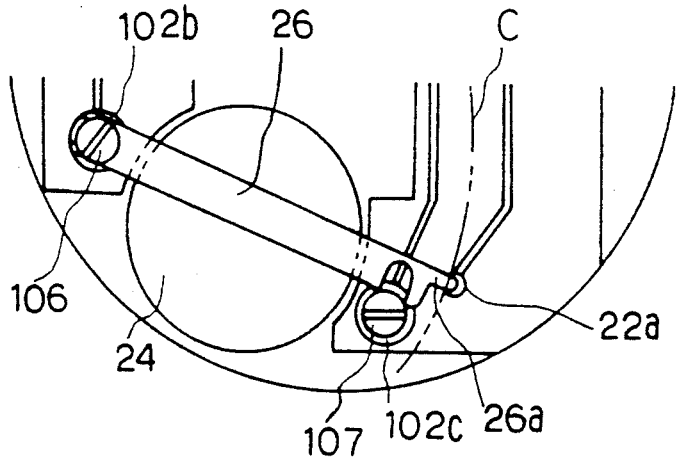
Figure 14C:
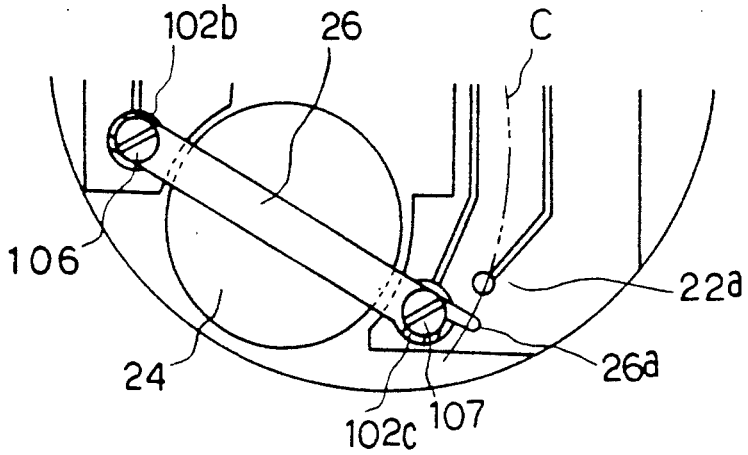

First, as shown in FIG. 14 (*a*), after insertion of the battery 24, the battery keep plate 26 is connected to the power terminal 102*b* by the holding screw 106. At this time, the holding screw 106 is tightened to the extent that the battery keep plate 26 can move rotatably around the holding screw 106. At the same time, the holding screw 107 is temporarily fastened to the power terminal 102*c*.

Then, the battery keep plate 26 is rotated in the direction of the power terminal 102*c* along the chain line C, while the battery 24 is being pushed down by the battery keep plate 26 resisting the pressure from the battery receiving spring 25. During this rotation the extended section 26*a* of the battery keep plate 26 contacts the reset terminal 22*a* as shown in FIG. 14(*b*).

As a result, the VDD 36*a* of the chip circuit 36 and the reset terminal 22*a* are short-circuited through the battery keep plate 26, and the chip circuit 36 is reset, or, specifically, the microcomputer is initialized. In addition, the rotation of the battery keep plate 26 is continued so that it contacts the power terminal 102*c* before the extension section 26*a* is apart from the reset terminal 22*a*, and, as shown in FIG. 3(*c*), the battery keep plate 26 is connected to the power terminal 102*c* by the holding screw 107. The holding screws 106, 107 are then fully tightened and the battery is securely held to ensure electrical contact of the power circuit.

Figure 15:
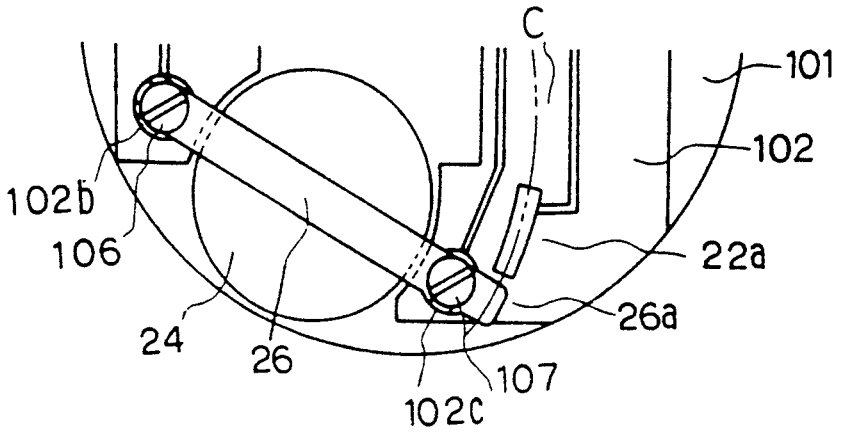
FIG. 15 is a plan view of the reset switch structure in the second embodiment.

FIG. 15 is a plan view showing a second embodiment of the present invention. The same reference numerals are used for the main elements as for those of the first embodiment shown in FIG. 12. Further explanation of these elements is therefore omitted.

In this embodiment, the width of the extended section 26*a* of the battery keep plate 26 is almost the same as the width of the battery keep plate 26. The reset terminal 22*a* is also lengthened in the form of a narrow strip along the circle drawn by the extended section 26*a* (double dotted chain line C). The spacing between the reset terminal 22*a* and the extended section 26*a* of the battery keep plate 26 after it has been secured by the holding screws 106, 107 is only sufficient to prevent contact between the two.

As a result of the above configuration, in the operation of the reset switch explained for the first embodiment shown in FIG. 14, among the total distance for which the extended section 26*a* is movable, the proportion of the distance in which the extended section 26*a* contacts the reset terminal 22*a* can be increased. Accordingly, the operation of installing the battery and the reset of the chip circuit can be made more reliable because there is increased opportunity for contact between the extended section 26*a* and the reset terminal 22*a* in the rotary motion of the battery keep plate 26.

In other words, the reset operation in which the extended section 26*a* contacts the reset terminal 22*a* can be made more reliable, even in the state where the battery keep plate 26 is inserted into the holding screw 107 which temporarily holds the power terminal 102*c* by a small extent, immediately before the battery keep plate 26 is secured.

Next, a third embodiment will be explained with reference to the drawings.

Figure 16:
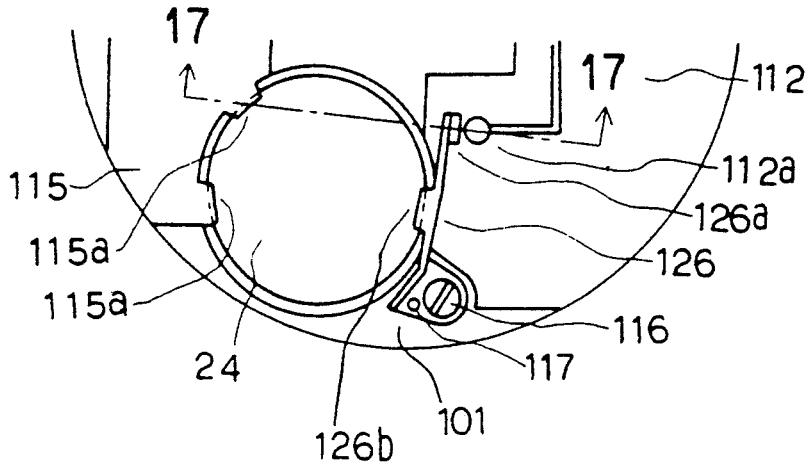
FIG. 16 is a plan view of the reset switch structure in the third embodiment.
Figure 17:
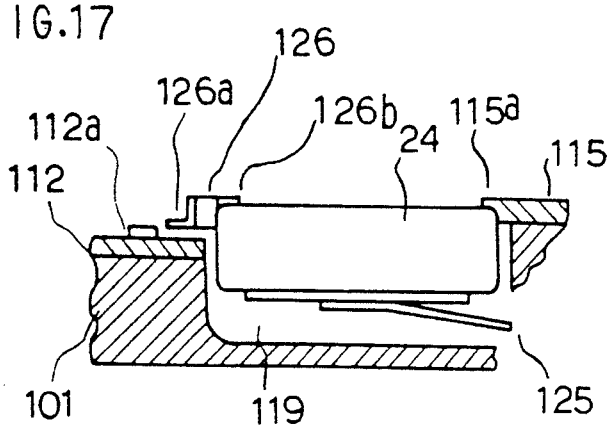
FIG. 17 is a sectional view along the section 17—17 of FIG. 16.
Figure 18A:
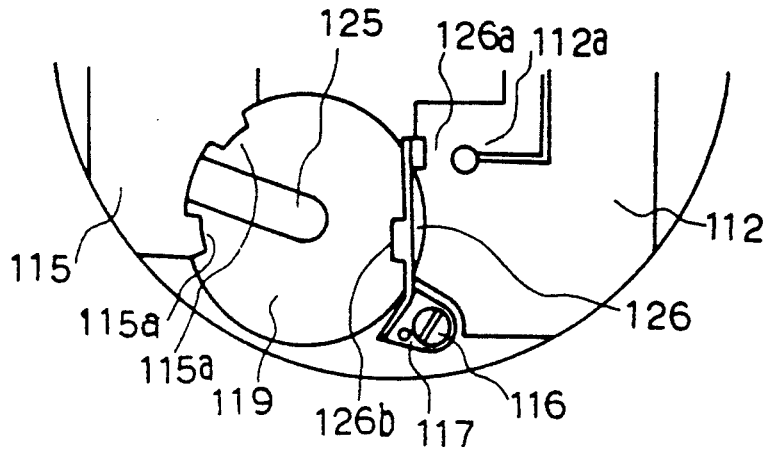
FIGS. 18(*a*) and 18(*b*) are views illustrating the operation of the reset switch of the third embodiment.
Figure 18B:
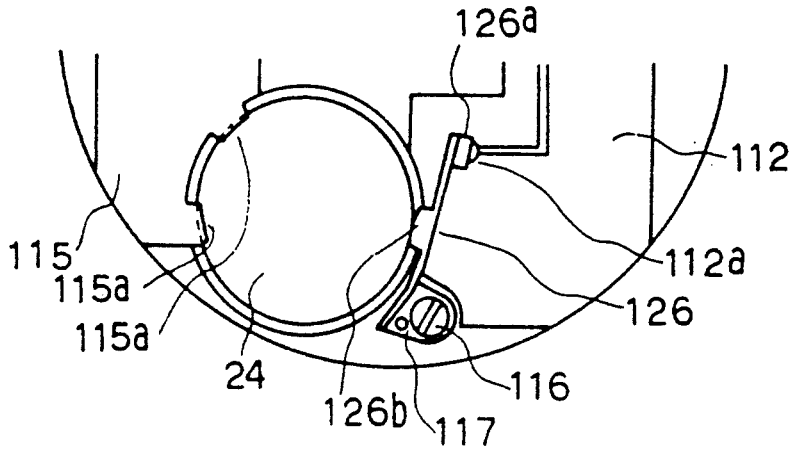

FIG. 16 is a plan view showing the rear cover of the electronic watch removed; FIG. 17 is a cross-sectional view taken along the section 17—17 in FIG. 16. FIG. 18 is a view for explaining the reset operation.

As shown in FIG. 16, the reset switch of this embodiment comprises an extended section 126*a*, a battery keep plate 126 provided with a battery keep section 126*b*, a circuit substrate 112 provided with a reset terminal 112*a*, and a battery receiver 115 provided with a battery receiver extended section 115*a*.

This configuration will now be explained in detail with reference to FIG. 17 which is the cross-sectional view taken along the section 17—17 in FIG. 16.

The battery receiver 115 serves the dual purpose of securely holding the battery by means of the battery receiver extended section 115*a* and acting as an electrode terminal. The battery receiver 115 is connected to a VDD (omitted from the drawings) which is the plus side of the power terminal of the chip circuit. The battery keep plate 126 is secured to the watch case 111 by a holding screw 116 and is set in that position by a pin 117. The battery keep plate 126, with a spring force toward the center of the battery 24 by its own spring characteristics, serves the dual purpose of holding the battery securely by the battery keeping plate 126 and acting as an electrode terminal, therefore it is connected to the VDD (omitted from the drawings) which is the plus side of the power terminal of the chip circuit.

A battery receiving spring 125 is connected to a VSS (omitted from the drawings) which is the minus side of the power terminal of the chip circuit and constructed so as to presses the battery 24 from the bottom to provide electrical contact with the battery .24. The reset terminal 122*a* is connected to the corresponding terminal of the chip circuit on the circuit substrate. The reset terminal 112*a* is positioned so that it contacts the extended section 126*a* when the battery keep plate 126 slides to the right in FIG. 16.

The operation of the reset switch will now be explained, based on FIG. 18. FIG. 18*a* illustrates the state before the installation of the battery. The battery keep plate 126 is released and swings to the left from the battery installed state of FIG. 16 from its own spring force. Here, if the battery 24 is inserted into a battery storage section 119, and moved downward while resisting the pressure from the battery receiving spring 125, the side surface section of the battery 24 is pressed against the battery keep section 126*b* of the battery keep plate 126 so that the battery keep plate 126 slides to the right, as shown in FIG. 18(*b*).

At this point of time, the extended section 126*a* of the battery keep plate 126 contacts a reset terminal 112*a*. As a result, the VDD of the chip circuit and the reset terminal 112*a* are short-circuited, and the microcomputer is initialized. Also, when the battery 24 is pressed downward, as shown in FIG. 16, the battery 24 is securely held by the battery receiver extended section 115*a* and the battery keep section 126*b*. Then, when the battery keep plate 126 is returned to the battery insertion state by its spring force, the extended section 126*a* is separated from the reset terminal 112*a*.

The microcomputer therefore can be initialized automatically and reliably by merely inserting the battery in the normal manner.

Obviously, numerous modifications and variations of the present invention are possible in light of the above teachings. It is therefore to be understood that within the scope of the appended claims, the invention may be practiced otherwise than as specifically described herein.

What is claimed is:

1. An electronic wrist watch equipped with a receiving device comprising:

a watch case, a glass windshield attached to the watch case for covering the watch case and having an indented section at a side of the watch case, a timepiece module for calculating time, said timepiece module being situated inside the watch case, a timepiece display section situated inside the watch case between the glass windshield and the timepiece module, and an antenna situated between the glass windshield and the time piece display section, said antenna including an antenna core, an antenna wire would around the antenna core, and a conductive antenna terminal sheet fixed to the antenna wire, said antenna core and the antenna wire being located inside the indented section antenna being electrically connected to the timepiece module through the conductive antenna terminal sheet by inserting into the timepiece module from a side of the glass windshield.

2. The electronic wrist watch equipped with a receiving device according to claim 1, wherein a shield plate is provided between said antenna and a circuit substrate and between said antenna and a step motor.

3. The electronic wrist watch equipped with a receiving device according to claim 1, wherein a bezel secured to the watch case and provided on the periphery of the antenna is made of ceramic.

4. The electronic wrist watch equipped with a receiving device according to claim 1, wherein an indented section is provided on the undersurface of the glass windshield for housing the antenna.

5. The electronic wrist watch equipped with a receiving device according to claim 1, wherein the antenna is positioned on the longitudinal direction passing through the center of the dial so as to make the display areas on the both sides of the antenna almost equivalent.

6. The electronic wrist watch equipped with a receiving device according to claim 5, wherein the dial is provided on the right side of the timepiece display section and a function display section is provided on the left side of the dial.

7. The electronic wrist watch equipped with a receiving device according to claim 6, wherein said function display section for displaying functions other than the time, which is provided on the left side of the antenna in the dial, is sectorially formed.

8. The electronic wrist watch equipped with a receiving device according to claim 6, wherein the hand provided on the dial in the left side of the antenna for displaying functions other than the time performs a monitor display.

9. The electronic wrist watch equipped with a receiving device according to claim 1, which has a mode displaying section wherein the time is switched by hands.

10. The electronic wrist watch equipped with a receiving device according to claim 9, which comprises, a mode wheel on which is mounted a mode hand which indicates various function;

an intermediate mode wheel with a gear section for engaging the mode wheel and a plurality of angled section;

a setting lever for engaging an external operating means;

a setting lever spring which engages the setting lever and determines the positioning of the setting lever;

a rotatable mode switching lever engaging the setting lever;

a return spring for engaging the mode switching lever and imparting spring pressure in the direction of the setting lever;

a jumper for engaging the angled sections of the intermediate mode wheel and positioning the rotating direction of the intermediate mode wheel; and a mode switching spring which rotates with the intermediate mode wheel and bends between the intermediate mode wheel and a circuit substrate; and wherein the mode switching lever is pressed by the setting lever by operating an external push-pull operating member, effecting the contact of the tip of the mode switching lever and an angled section of the intermediate mode wheel and rotating the angled section for one pitch rotation, thereby rotating the mode wheel for one mode.

11. The electronic wrist watch equipped with a receiving device according to claim 10, wherein said intermediate mode wheel has a plurality of angled sections for appropriately matching the stroke of the mode-switching lever driven by the operation of the external operating member and the stroke of one pitch part of the angled sections of the intermediate mode wheel, thereby performing the conduction between mode-switching patterns corresponding to each mode by means of a mode-switching lever switch spring which rotates together with the intermediate mode wheel.

12. The electronic wrist watch equipped with a receiving device according to claim 1, which has a sector display gear train modification mechanism comprising, a hands wheel for sector display by hands from the rotation of a step motor forward and in reverse;

a rotor for driving the hands wheel;

a slowdown gear train for transmitting the rotation of the rotor to the hands wheel, a regulated member being formed on the slowdown gear train between the hands wheel and the rotor and a rotation regulating member linked to an external operating member being further provided; and wherein said rotation regulating member engages a controlled member in the forward rotation direction of said rotor and rotates to the direction apart from said controled member, whereby it is possible, by means of the rotation regulating member, to extricate said rotor from condition in which reversing is impossible.

13. The electronic wrist watch equipped with a receiving device according to claim 1, wherein said timepiece display section is a dial for an analogue timepiece.

14. The electronic wrist watch equipped with a receiving device according to claim 1, further comprising an antenna support plate fixed to the timepiece module, said antenna terminal sheet being fixed to the antenna support plate by a screw.

15. The electronic wrist watch equipped with a receiving device according to claim 1, wherein said antenna core is formed at the glass windshield side above the watch case.

16. The electronic wrist watch equipped with a receiving device according to claim 1, further comprising antenna winding frames fixed at longitudinal ends of the antenna core, said antenna wire being situated between the antenna winding frames, said antenna terminal sheet being attached to the antenna winding frame.

17. The electronic wrist watch equipped with a receiving device according to claim 16, further comprising a bezel situated between the glass windshield and the watch case, said antenna core with the antenna wire being located in a plane as in the bezel and above the watch case.

* * * * *